US008869350B2

(12) United States Patent
Gruber

(10) Patent No.: US 8,869,350 B2
(45) Date of Patent: Oct. 28, 2014

(54) TORSION BAR DOOR CHECK

(75) Inventor: Rudolph Gruber, Uxbridge (CA)

(73) Assignee: Multimatic Inc., Markham (CA)

( * ) Notice: Subject to any disclaimer, the term of this patent is extended or adjusted under 35 U.S.C. 154(b) by 0 days.

(21) Appl. No.: 13/605,582

(22) Filed: Sep. 6, 2012

(65) Prior Publication Data

US 2013/0055530 A1 Mar. 7, 2013

Related U.S. Application Data

(63) Continuation-in-part of application No. 13/226,348, filed on Sep. 6, 2011, now abandoned.

(51) Int. Cl.
*E05C 17/20* (2006.01)
*E05B 15/16* (2006.01)

(52) U.S. Cl.
CPC ..... *E05B 15/1635* (2013.01); *E05C 17/203* (2013.01)
USPC ..... 16/85; 16/82

(58) Field of Classification Search
CPC ..... E05C 17/00; E05C 17/025; E05C 17/203; E05C 17/206; E05C 17/22; E05C 17/24; E05C 17/26; E05C 17/28; E05C 21/005; E05F 5/025; E05F 5/00; E05F 5/022; E05B 2015/0455
USPC ..... 16/85, 82, 86 R, 86 A, 86 B, 86 C, 334; 292/262, 265, 275, 277
See application file for complete search history.

(56) References Cited

U.S. PATENT DOCUMENTS

| | | | | |
|---|---|---|---|---|
| 2,125,010 | A * | 7/1938 | Wright | 16/86 C |
| 2,204,330 | A * | 6/1940 | Travis | 16/85 |
| 2,204,331 | A * | 6/1940 | Travis | 16/85 |
| 2,237,046 | A * | 4/1941 | Breitenwischer | 16/86 C |
| 2,291,412 | A * | 7/1942 | Schonitzer | 16/86 C |
| 5,026,103 | A | 6/1991 | Tolle et al. | |
| 5,112,091 | A | 5/1992 | Kluting | |
| 5,173,991 | A | 12/1992 | Carswell | |
| 6,370,733 | B2 | 4/2002 | Paton et al. | |

(Continued)

FOREIGN PATENT DOCUMENTS

| | | | |
|---|---|---|---|
| EP | 0111380 | B1 | 6/1984 |
| GB | 795867 | A | 6/1956 |
| WO | 03042477 | A1 | 5/2003 |
| WO | 2009124373 | A1 | 10/2009 |

OTHER PUBLICATIONS

McTavis, Megan; International Search Report from corresponding PCT Application No. PCT/CA2012/050614; search completed Dec. 19, 2012.

*Primary Examiner* — Jeffrey O Brien
(74) *Attorney, Agent, or Firm* — John R. S. Orange; Blake, Cassels & Graydon LLP

(57) ABSTRACT

A door check for an automobile has an arm with a cam formed between oppositely directed flanks. A unitary energy storage component cooperates with the arm to provide progressive resistance to opening and closing and a plurality of stable positions. The unitary energy storage component includes a pair of springs, each connected to shoes that bear against the flanks and load the springs in torsion as the shoes moves along the cam. The unitary energy storage component is formed as an integral unit to facilitate handling and assembly.

13 Claims, 10 Drawing Sheets

(56) References Cited

U.S. PATENT DOCUMENTS

| | | | | |
|---|---|---|---|---|
| 6,481,056 | B1 | 11/2002 | Jesse | |
| 6,568,741 | B1 * | 5/2003 | Leung et al. | 16/334 |
| 6,687,953 | B1 | 2/2004 | Liang | |
| 6,842,943 | B2 | 1/2005 | Hoffmann et al. | |
| 6,880,204 | B2 * | 4/2005 | Ochiai | 16/82 |
| 6,901,630 | B2 * | 6/2005 | Liang et al. | 16/82 |
| 7,946,017 | B2 * | 5/2011 | Brown et al. | 29/426.6 |
| 2003/0101537 | A1 * | 6/2003 | Matsuki et al. | 16/85 |
| 2004/0049882 | A1 * | 3/2004 | Schmoll et al. | 16/82 |
| 2004/0060150 | A1 * | 4/2004 | Krozek | 16/86 C |
| 2004/0111832 | A1 * | 6/2004 | Murayama et al. | 16/82 |
| 2004/0148735 | A1 * | 8/2004 | Spalding et al. | 16/82 |
| 2006/0150367 | A1 * | 7/2006 | Matsuki | 16/86 C |
| 2006/0207058 | A1 * | 9/2006 | Heinrichs et al. | 16/86 B |
| 2006/0207059 | A1 * | 9/2006 | Van Den Heuvel | 16/86 B |
| 2007/0245519 | A1 * | 10/2007 | Woo | 16/86 C |
| 2008/0066260 | A1 | 3/2008 | Clark | |
| 2009/0070956 | A1 * | 3/2009 | Hoffmann et al. | 16/82 |
| 2011/0016665 | A1 | 1/2011 | Ng | |

* cited by examiner

TORSION BAR DOOR CHECK

CROSS-REFERENCE TO RELATED APPLICATIONS

This application is a continuation-in-part of U.S. patent application Ser. No. 13/226348 filed on Sep. 6, 2011, the contents of which are incorporated herein by reference.

FIELD OF THE INVENTION

This invention relates to automotive door checks, and in particular to a compact mechanical device capable of holding an automotive door in one or more predetermined open positions with a predetermined force.

DESCRIPTION OF THE PRIOR ART

It has been found useful to check the movement of an automotive door in a number of predetermined open positions to assure convenient and safe ingress/egress of the occupants. The door is normally checked against movement in at least one open position with an effort or resistive force adequate to resist wind gusts and the effect of parking on an incline or grade.

The most common form of automotive door check is a mechanical device that resists motion by releasably storing energy in response to forced motion of the system. These devices, located between the vehicle's body structure and door, can be configured to be integral with the door hinge or separate as autonomous mechanical assemblies. Energy storage is generally achieved by a form of spring with coil and torsion arrangements being the most popular configurations. As the door is opened or closed, the door check is configured to release energy entering the check positions and to store it when moving out of the check positions. The most common method of storing energy in the spring system is by means of a cam arrangement that moves in conjunction with the door. This cam can work within the hinge to ultimately produce a torque around the pivot axis of the hinge, or can work linearly in a separate checking apparatus which produces a force vector to resist door movement at selected opening positions.

U.S. Pat. No. 5,173,991 to Carswell describes a common type of separate door checking apparatus that utilizes a molded link member to provide a cam arrangement and a pair of coil springs to releasably store energy. The coil springs are contained in a check housing and are acted upon by the molded link member via ball bearings and ball bearing retainers. The check housing is rigidly attached to the vehicle door and the molded link member is pivotally connected to the vehicle body structure. The device of Carswell provides a robust, reliable and relatively compact solution for checking the movement of an automotive door. There are numerous similar solutions that utilize rollers or sliders in place of the ball bearings of Carswell. U.S. Pat. No. 6,370,733 to Paton et. al. describes a separate checking apparatus that utilizes a molded link member or check arm and rollers. U.S. Pat. No. 6,842,943 to Hoffmann et. al. describes a separate checking apparatus that utilizes a molded check arm and sliders.

Because the automotive door check must be located between the vehicle's body structure and door, it is forced to occupy a severely restricted package space as there is limited clearance between the vehicle body structure and the door and very little volume available within the door. Additionally, the weight of the automotive door check apparatus must not be too great as a significant proportion of the door check apparatus mass resides within the door profile, which swings on a pivot and is highly sensitive to weight. In general, the manufacturing costs of automotive components are among the lowest of any comparable industry and so simple solutions with low part counts are highly desirable. The main focus of an automotive door check development is to attain the required check efforts in the smallest possible package at the lowest achievable weight and cost. Using as few components as possible is highly desirable as is the ease of assembly in to the body structure and the ability of the apparatus to withstand manufacturing processes to which the body structure is subjected. The type of spring and its related strain energy storage capability combined with the package efficiency of the actuation mechanism ultimately dictate the overall effectiveness of the automotive door check apparatus.

U.S. Patent Application 2011/0016665 to Ng shows an elegant solution of door check in which the number of components is reduced to an arm and a unitary body. The unitary body is formed with a pair of leaf springs that cooperate with the arm to store and release energy as the arm moves relative to the housing. This arrangement minimizes the number of components and thereby offers significant advantages. The use of leaf springs reduces the number of components required, but at the same time requires close control of the manufacturing process to attain the required consistency of operation. Relatively small variations in the material and dimensions can introduce variability in the characteristics of the leaf springs, that may not be acceptable to the ultimate end user of the door check.

The manufacturing tolerances affecting the characteristics of a torsion spring are easier to control. U.S. Pat. No. 6,687,953 to Leang discloses a door check device in which a torsion spring is utilized to bias rollers against the flanks of the door check arm. Whilst the torsion spring provides uniform physical characteristics, the arrangement shown in Leang, utilizes a significant number of components including rollers and a housing in which the torsion spring is supported. This introduces mechanical complexity and weight to the assembly, as well as requiring assembly to the door after body has been painted as the components cannot withstand the painting process.

EP 1759080 to Friedr. Fingscheidt GmbH shows a door check in which a spring steel wire is bent in to a complex shape to provide an energy storage device. The forming of the wire is complex and work intensive. In the majority of embodiments, the storage element acts on only one side of the check strap and additional components are required to provide support for the resilient energy storage device. The configuration of the latching elements in embodiments that act on both sides of the check straps introduces complex loading and limits the free length of the energy storage devices.

It is therefore an object of the present invention to provide a door cheek in which the above disadvantages are obviated or mitigated.

SUMMARY OF THE INVENTION

In general terms, the present invention provides a door check which has a check arm and a unitary energy storage component that cooperates with the arm as a door moves between open and closed positions. The unitary energy storage component is integrally formed as a single component that functions to store energy and facilitate assembly and handling. The unitary energy storage component utilizes a pair of torsion springs that are each connected to shoes that slide on the arm as the door opens and closes. Mounting brackets are provided on the torsion springs which allow rotary motion between the brackets and springs as they are loaded in torsion. The springs, mounting brackets and shoes are co-moulded as an integral unit, preferably in a single molding operation, to facilitate handling and assembly.

In accordance with one aspect of the present invention there is provided a door check for an automobile comprising:

a) a check arm having cam surfaces formed on oppositely directed flanks;

b) a unitary energy storage component containing a pair of torsion springs;

c) the torsion springs integrally co-moulded with a pair of mounting brackets and a pair of shoes to create a single unitary component;

d) the torsion springs extending in opposite directions from the shoes.

e) the mounting brackets configured to allow rotary motion of the torsion springs and co-moulded with fasteners adapted to structurally attach the unitary energy storage component to a vehicle door structure;

such that the shoes of the unitary energy storage component are operably engaged with the flanks of the check arm to accommodate relative sliding movement between the check arm and the unitary energy storage component, whereby, movement of the shoes along said flanks varies the spacing between said shoes and thereby the energy stored in the torsion springs.

Preferably, each of the torsion springs has a pair of legs and the legs are loaded in torsion by variation of the spacing of the shoes.

Preferably, also feet extend from the legs and the shoes are connected to the feet.

Preferably, the brackets and shoes are molded on the springs after placement of the springs in a common mold to provide a unitary structure.

BRIEF DESCRIPTION OF THE DRAWINGS

Embodiments of the present invention will now be described by way of example only with reference to the accompanying drawings in which.

DETAILED DESCRIPTION OF EMBODIMENT

Figure 1:
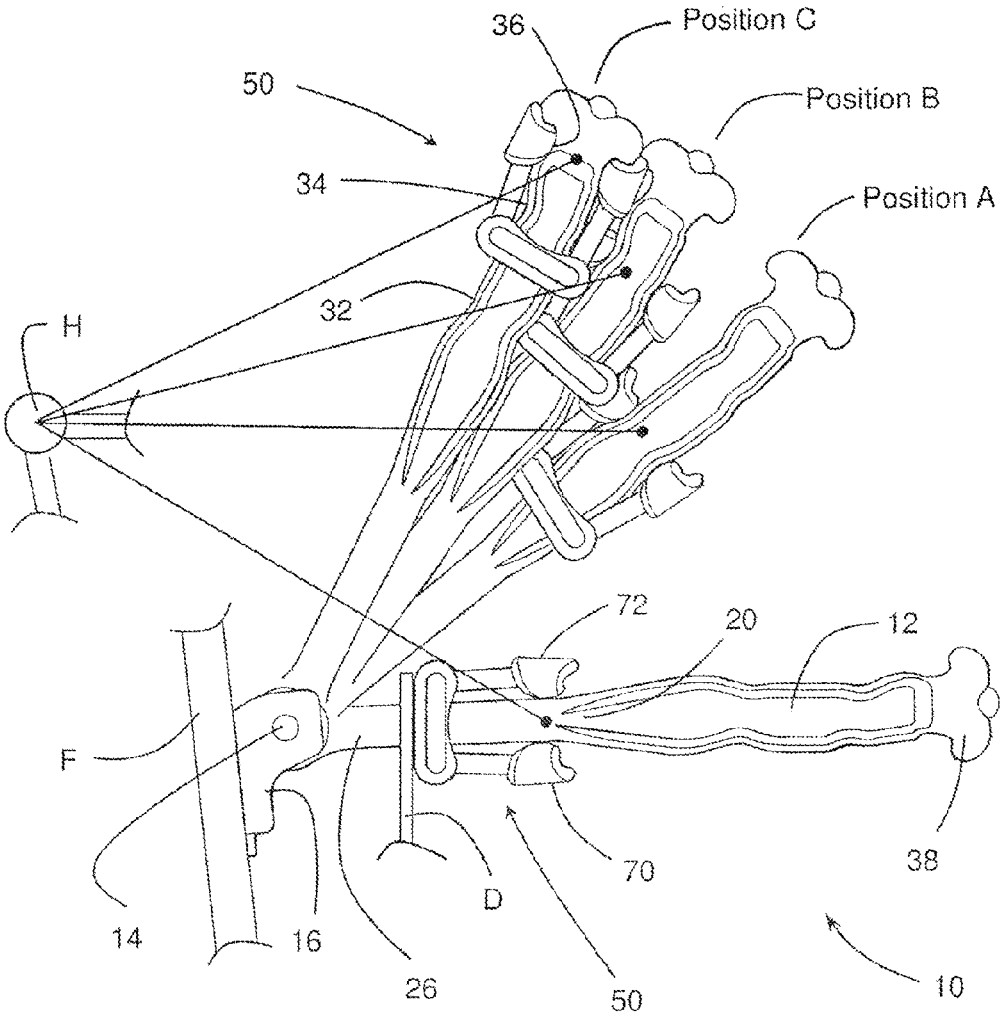
FIG. 1 is a representation of a door assembly with a door check showing the disposition of the components as a door moves from a closed to an open position.

Referring therefore to FIG. 1, a door check 10 is located between a door frame F and a door D of a vehicle. The door D is pivotally connected to the frame F by means of a hinge H, that defines an axis of rotation of the door D relative to the frame F.

Figure 2:
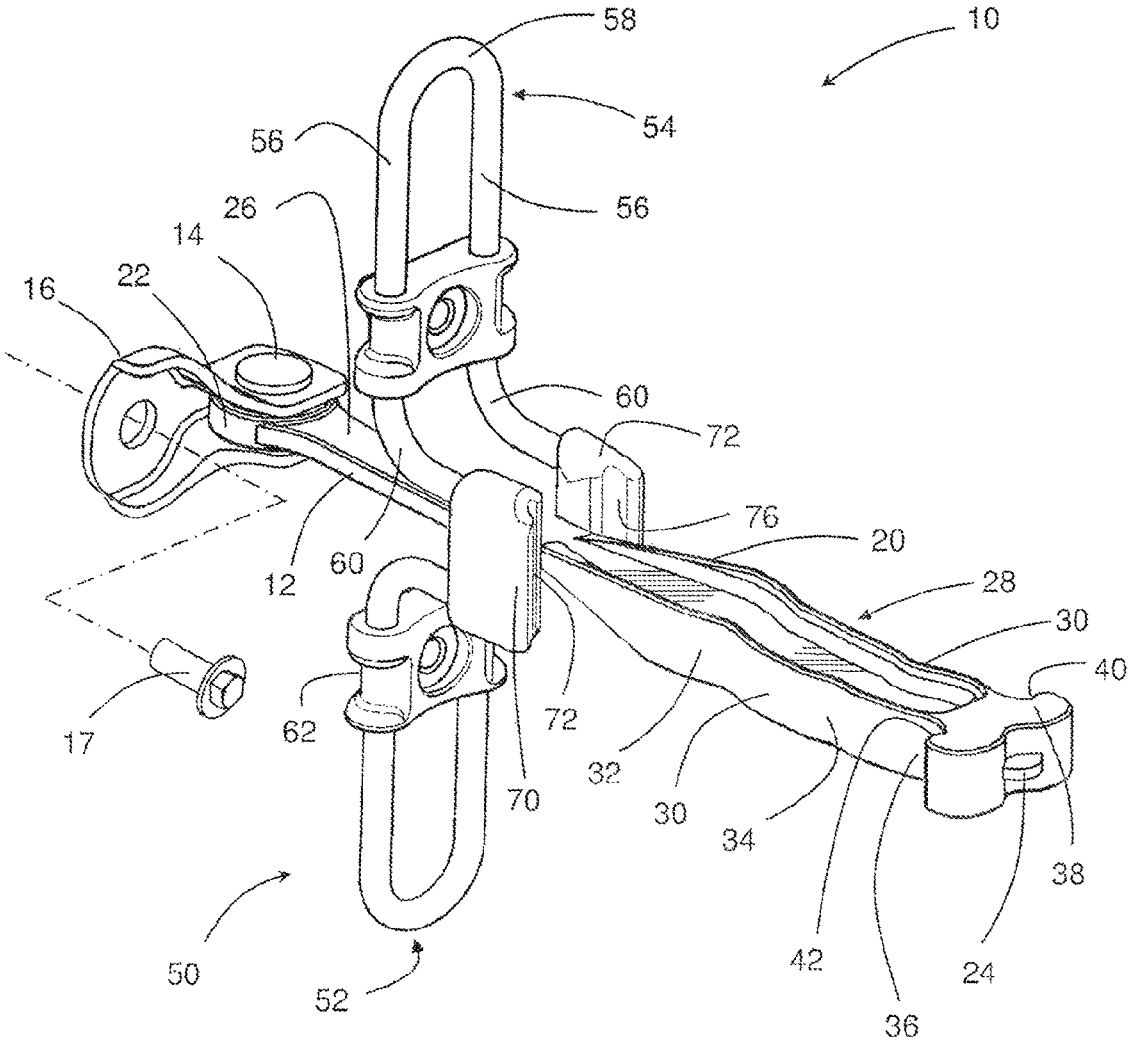
FIG. 2 is a perspective view of a door check.
Figure 3:
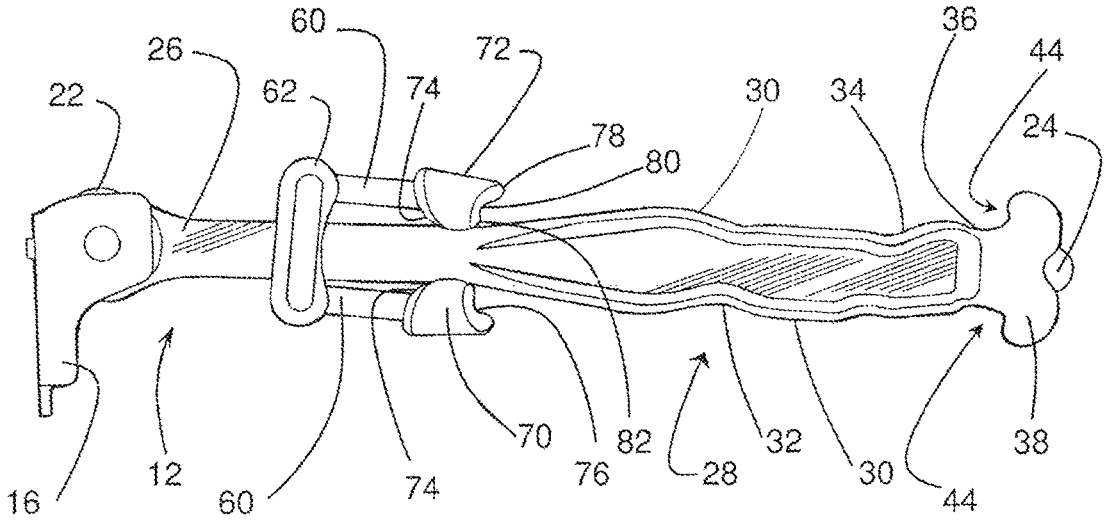
FIG. 3 is a plan view of the door check shown in FIG. 2.

As best seen in FIGS. 2 and 3, the door check 10 includes a check arm 12 that is pivotally connected by a pin 14 to a clevis plate 16. The clevis plate 16 is secured to the frame F through a bolt, 17, or similar fastener to locate the arm 12 relative to the frame.

The arm 12 has an elongate body 20 that extends from a knuckle 22, through which the pin 14 passes. The body 20 is molded from a plastics material about a central metallic core 24. The body 20 includes a shank 26 extending from the knuckle 22 that in turn merges with a cam 28. The cam 28 is moulded to provide a generally I-shaped cross section with oppositely directed flanks 30.

The width of the cam 28, that is the lateral spacing between the flanks 30, varies along the length of the arm 12 with localized reductions in the width to provide waisted portions 32, 34, 36 at spaced locations.

Figure 4:
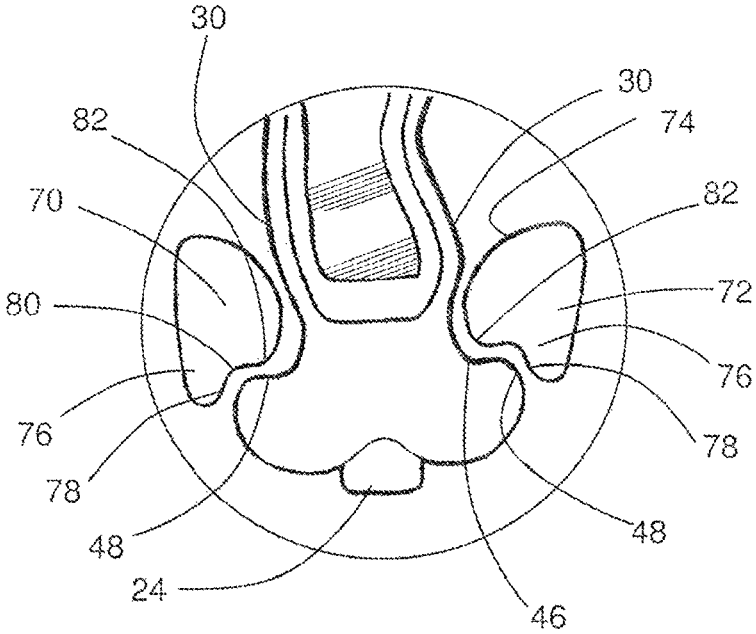
FIG. 4 is an enlarged view of a portion of the door check at the position C shown in FIG. 1.

Referring to FIGS. 3 and 4, the distal end of the arm 12 is formed with an enlarged head 38, which has a pair of undercut lobes 40, 42 projecting laterally to either side of the arm 12. The lobes 40, 42 each have an abutment face 44 formed by a curved recess 46 adjacent the flank 30 and a protuberance 48 outboard of the recess 46.

Figure 6:
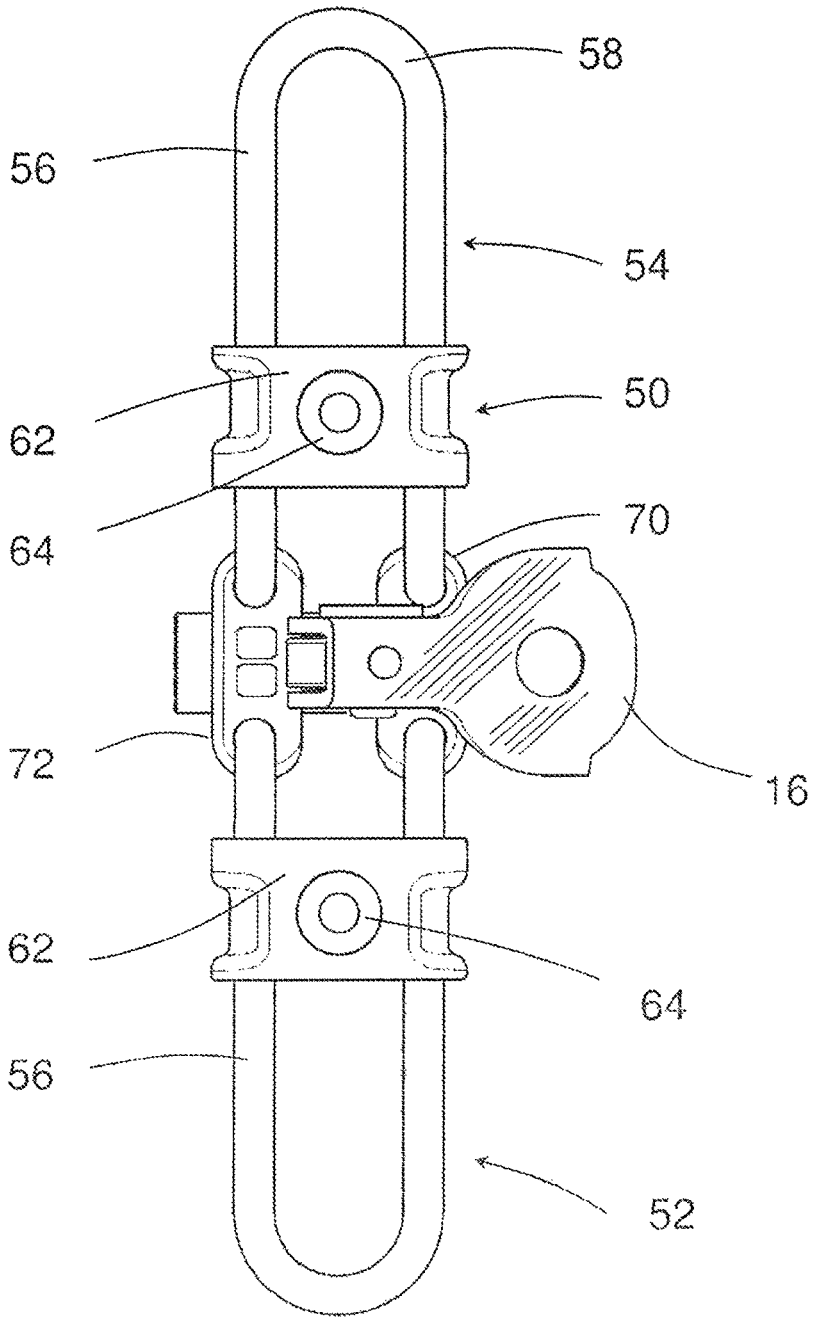
FIG. 6 is an end view of the door check shown in FIG. 2.

Referring again to FIG. 2 and to FIG. 6, the door check 10 further includes a unitary energy storage component 50 secured to the door D and cooperating with the arm 12 to control pivotal movement between the door and the frame F. The unitary energy storage component 50 includes a pair a torsion springs 52, 54 that extend to opposite sides of the arm 12. Each of the springs 52, 54 has a pair of parallel legs 56 interconnected by a curved bight 58. The end of the legs 56 turn through 90° to provide a pair of parallel projecting feet 60.

Figure 5:
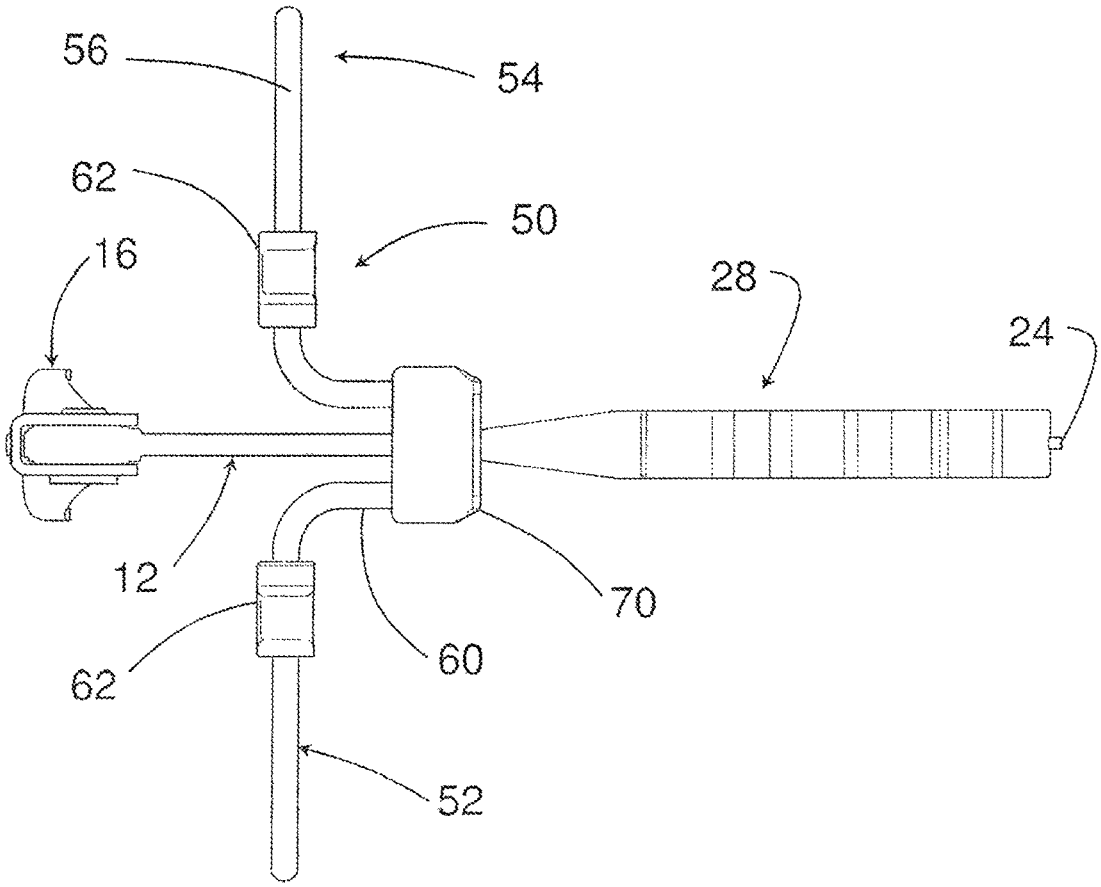
FIG. 5 is a side elevation of the door check shown in FIG. 2.

The legs 56 are maintained in spaced parallel relationship by means of a bracket 62. The bracket 62 is made from a plastics material, such as a glass filled nylon 66 known by the trade name Zytel, that, as described in greater detail below, is moulded about the legs 56. A fastener 64, either a nut, bolt or similar fastener, is embedded in the bracket 62 to facilitate connection of the bracket 62 to the door D. As seen in FIGS. 2,5 and 6, the bracket 62 encompasses the legs 56 so as to be retained in situ on the legs 56 but permits rotation of the leg within the bracket 62 about the longitudinal axis of the legs 56. The appropriate selection of the materials, or localised surface treatment, ensures that the bracket 62 does not adhere to the legs 56 and so permits the limited rotational movement of the legs 56 relative to the bracket 62.

The torsions springs 52, 54 are disposed on opposite sides of the arm 12 and are interconnected by a pair of shoes 70, 72. The shoes 70, 72 are secured to respective ones of the feet 60 so the springs 52, 54 and shoes 70, 72 provide a unitary structure. The shoes 70, 72 are moulded from a high density low friction plastic, such as an acetal known by the trade name Delrin, that are integrally moulded to the feet 60 to provide a unitary construction.

As seen most clearly in FIGS. 3 and 4, the inwardly directed face 74 of the shoes 70, 72 is contoured to provide a generally convex surface that is complementary to the waisted portions 32, 34, 36 of cam 28. The leading edge 76 of each of the shoes 70, 72 is undercut to be complementary to the contours of abutment face 44 of lobes 40, 42. Each of the leading edges 76 has an outer lip 78 that merges smoothly with a recess 80 of complimentary profile to the protuberance 48. A nose 82 projects from the recess 80 and is complimentary to the recess 46 on the head 38.

The lateral spacing of the legs 56 is such that, when the shoes 70, 72 are positioned on the shank 26, there is a small preload in the torsion springs 52, 54, to bias the convex surfaces 74 of the shoes 70, 72 against the shank 26 while offering nominal resistance to movement. The springs 52, 54 are made from a suitable spring material, such as a standard music wire.

In use, with the door closed, the shoes 70, 72 are in sliding engagement with the flanks 30 adjacent to the transition between the shank 26 and cam 28 of the arm 12. In this position, the legs 56 are in their free body condition with the shoes 70, 72 in sliding engagement with the flanks 30.

As the door opens, relative movement between the arm 12 and the unitary energy storage component 50 causes the shoes 70, 72, slide along the flanks 30. The arm 12 progressively widens and the increased spacing of the flanks 30 forces the shoes 70, 72 apart. The increased spacing of the shoes 70. 72 rotates the legs 56 in opposite directions and stores energy within the torsion springs 50, 52 by torsionally loading the legs 56. Each of the springs 52, 54 is similarly loaded and the forces acting on opposite side of the arm in 12 are balanced.

Continued movement of the door, as indicated in FIG. 1, moves the shoes 70, 72 in to the first waisted portion 32 indicated at position A. As the shoes 70, 72 enter the first waisted portion 32, energy is released from the legs 56 and the convex face 74 of the shoes 70, 72 is received within the waisted portion 32. Movement of the shoes 70, 72 from the waisted portion 32 requires the legs 56 to be rotated causing energy to be re-stored in the legs 56. Accordingly, extraneous forces resulting from the mass of the door or the forces imposed by gusts of wind may be resisted.

Continued movement of the door again forces the shoes 70, 72 apart and stores energy in the torsion springs 52, 54. A further stable position for the door is provided when the shoes 70, 72 engage the waisted portion 34 indicated at position B. Continued movement beyond the waisted portion 34 moves the shoes 70, 72 in to the waisted portion 36 and into engagement with the head 38 as shown in position C. The head 38 thus provides a stop to define the maximum opening of the door.

In that position, as can best be seen in FIG. 4, the nose 82 enters the recess 46. The interaction of the nose 82 with the protuberance 48 inhibits relative lateral displacement of the shoes 70, 72 upon continued application of a force to the door.

Return of the door to the closed position causes the shoes 70, 72 to move along the flanks 30 and through the waisted portions 32, 34 until once again on the shank 26. The profile of the cam 28 is selected to provide the required resistance to sliding motion during travel between the waisted portions, and the required retention in each of the waisted portions.

Figure 7:
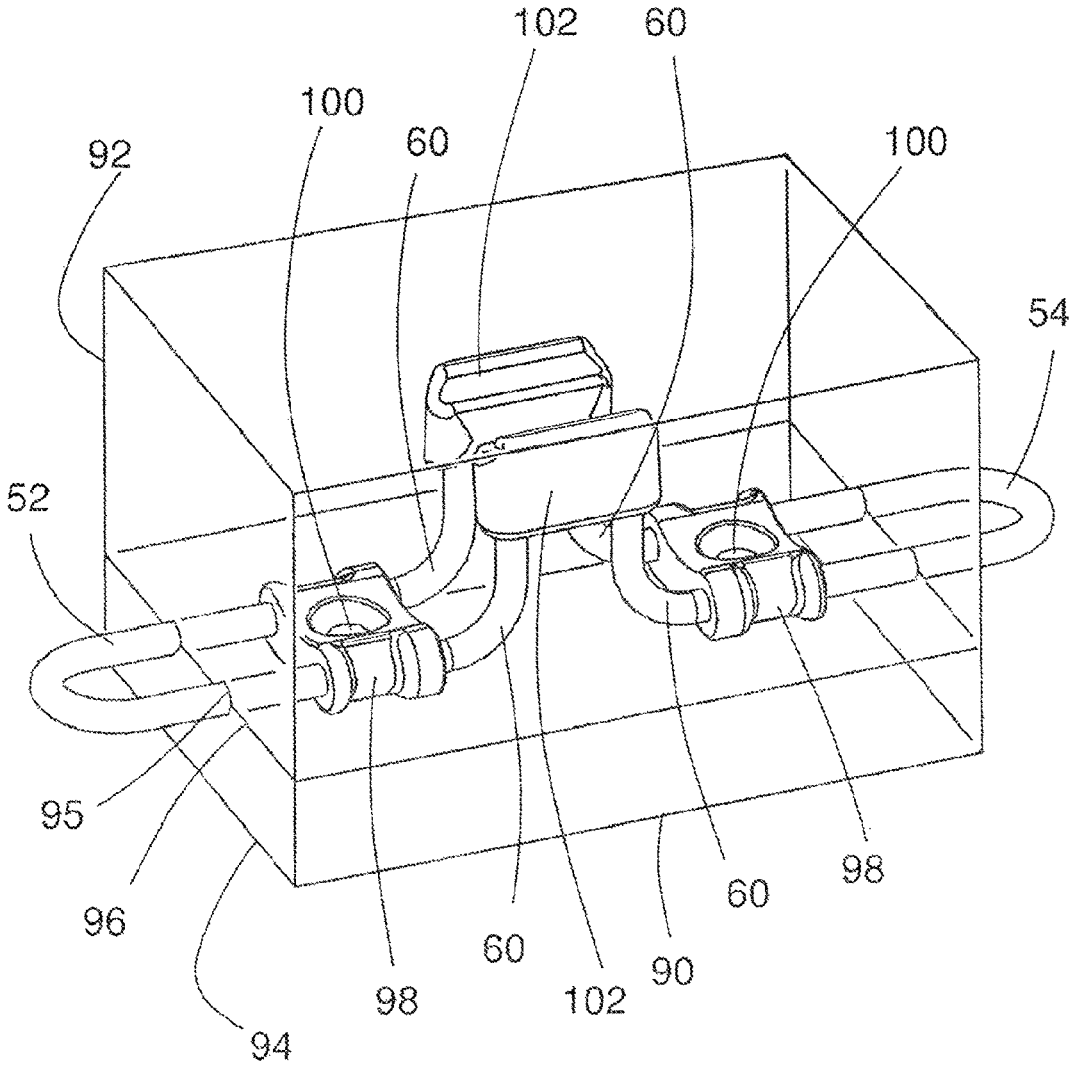
FIG. 7 is a schematic representation of the formation of a component of the door check of FIG. 2.

As shown schematically in FIG. 7, the unitary energy storage component 50 is formed by moulding the bracket and shoes 70, 72 to the torsion springs 52, 54 in a single molding operation to provide a unitary construction. A mold 90 is formed with upper and lower halves, 92, 94 that abut on a parting plane 96. A semi cylindrical track 95 is formed in each of the halves to receive and to locate the legs 56 of the springs 52, 54. The legs 56 pass through a lateral cavity 98 that is shaped to provide the brackets 62. A central boss 100 locates the fastener in the cavity 98. The feet 60 are received in shoe cavities 102 that are shaped to provide the profile of the shoes 70, 72.

With the mold 90 open, the springs 52, 54 are placed on the track 95 and fasteners 64 placed on the boss 100. The mold 90 is closed and plastics material injected in to the cavities 98. 102. Upon solidification, the mold 90 is opened and the unitary energy storage component 50 may be removed as a single component.

The unitary energy storage component 50 is therefore is provided as a single component with the shoes 70, 72 providing sufficient structural rigidity to maintain the unit 50 as one piece. After the unitary energy storage component 50 is mounted to the door, the brackets 62 maintain the relationship between the torsion springs and thereby permit the shoes to simply function as the slides rather than being required to maintain the structural integrity of the unitary energy storage component. The integral nature of the unitary energy storage component 50 and the absence of rollers and the like also enables the door check to be assembled with the body prior to painting, thereby simplifying subsequent assembly.

An alternative embodiment of door check assembly is shown in FIGS. 8 to 11 in which like reference numerals will be used to denote like components with a suffix "a" added for clarity.

Figure 8:
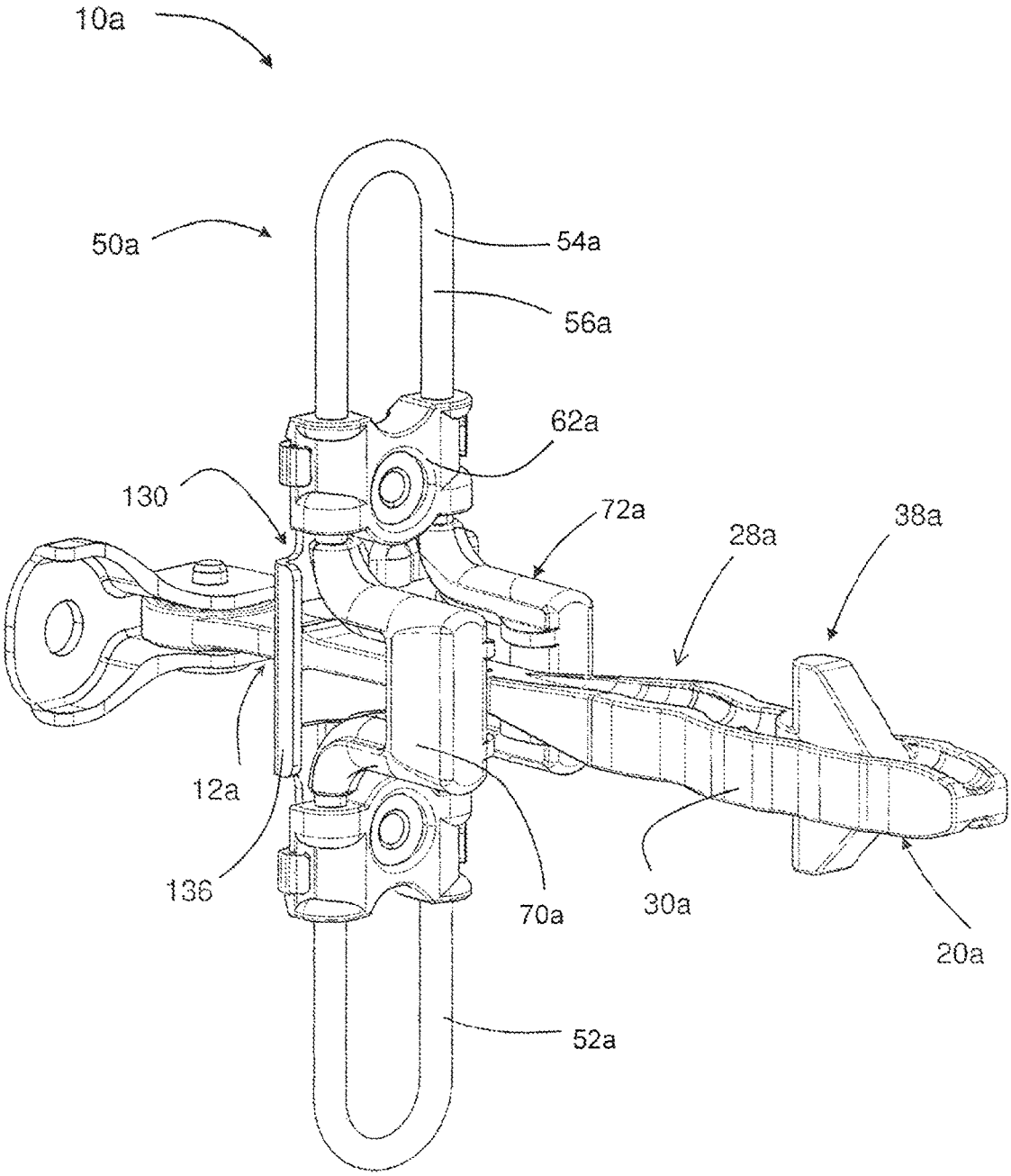
FIG. 8 is a perspective view similar to FIG. 2 of an alternative embodiment of door check.

Referring therefore to FIG. 8, a door check 10*a* has a check arm 12*a* with an elongate body 20*a*. The body 28*a* includes a cam 28*a* defined by flanks 30*a*. As can be seen in FIG. 12, the body 20*a* is moulded from a plastics material about a central metallic core 24*a*. The distal end of the shank 24*a* is formed with a triangular head 120 that is disposed orthogonal to the plane of the shank 24*a*. The head 120 provides an enlarged head 38*a* projecting to opposite sides of the cam 28*a* and lying between the flanks 30*a*. The head 38*a* is thus able to pass between the shoes 70*a* upon relative movement between the arm 12*a* and the energy storage component 50*a*.

The energy storage component 50*a* includes a pair of torsion springs 52*a*, 54*a* and are interconnected by shoes 70*a*, 72*a* to provide a unitary structure as described above. Brackets 62*a* maintain the legs 56 in space parallel relationship and provide mounting points for the energy storage component 50*a* to the door D.

A stop plate 130 is interposed between the energy storage component 50*a* and the door D. The stop plate 130 is formed as a separate component and may be secured to the energy storage component 50*a*. by for example tags or clips, to facilitate transportation and assembly, or may be permanently secured by integrating it in the molding process if appropriate. The stop plate has a planar body 132 and upturned edges 134, 136. The edges 134 engage with the bracket 62*a* to locate the plate 130 relative to the energy storage component 50*a*. The planar body 132 has a central aperture 138 through which the arm 12*a* may pass. A pair of ridges 140 are formed in the planar body 132 on oppositely facing edges of the periphery 138. The ridges 140 define a valley 142 centrally located on the plate 132.

Figure 10:
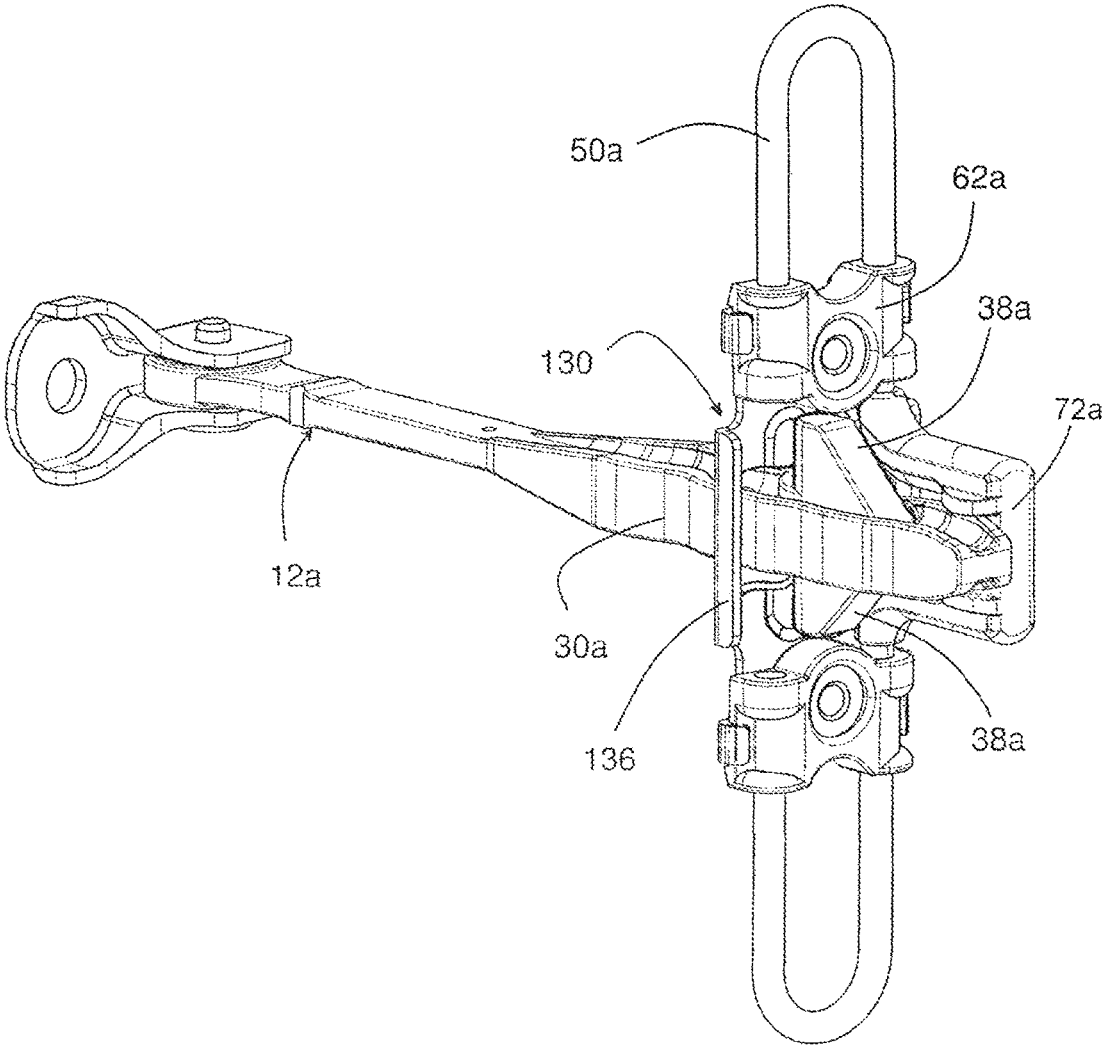
FIG. 10 is a view similar to FIG. 8 of the door check in a fully open position with a portion of the door check removed for clarity.

The ridges 140 and valley 142 are configured so that the enlarged head 38*a* engages in the valley 140 to locate the head laterally relative to the plate. As can be seen in FIG. 10, the head 38*a* engages the plate 130 to limit relative movement between the door and the car body thus providing a stop to define the maximum opening of the door. The forces imposed on the arm 12*a* are reacted by the plate 130, rather than by the shoes 70*a* as in the previous embodiment.

It will also be noted that the configuration of the enlarged head 38*a* between the flanks 30*a* enables the head 30*a* to be moved within the longitudinal extent of the cam 28*a* and therefore reduce the overall length of the door check, which reduces the volume required to mount the component in an automotive door that typically also needs to accommodate many other mechanisms such as window regulators, drop glass and audio speakers in the same general area.

What is claimed is:

1. A door check for an automobile comprising:

a) a check arm having cam surfaces formed on oppositely directed flanks;

b) a pair of shoes engaged with said cam surfaces;

c) a unitary energy storage component containing a pair of torsion springs, each of said torsion springs having a pair of legs;

d) each of the torsion springs supported by a respective one of a pair of mounting brackets;

e) each leg of one of the torsion springs being connected to the leg of another of the torsion springs by a respective one of said pair of shoes, said torsion springs extending in opposite directions from the shoes, said springs, mounting brackets and said pair of shoes creating a single unitary component;

f) the mounting brackets configured to allow rotary motion of the torsion springs relative to said mounting brackets;

such that the shoes of the unitary energy storage component are operably engaged with the flanks of the check arm to accommodate relative sliding movement between the check arm and the unitary energy storage component, whereby, movement of the shoes along said flanks varies the spacing between said shoes and thereby the energy stored in the torsion springs.

2. The door check according to claim 1 wherein feet extend from said legs and said shoes are connected to said feet.

3. The door check according to claim 1 wherein said cam is formed with at least one waisted portion in which the spacing between said flanks is locally minimized to provide a check position of said shoes along said arm.

4. The door check according to claim 1 wherein one end of said arm is provided with an enlarged head to limit relative movement of said arm and unitary energy storage component.

5. The door check according to claim 4 wherein said head has an abutment face engageable with said shoes and said abutment face is profiled to inhibit lateral movement of said shoes.

6. The door check according to claim 5 wherein each of said shoes has a nose received in a respective recess of said abutment surface.

7. The door check of claim 4 wherein said head is oriented to pass between said shoes.

8. The door check of claim 7 wherein said head projects from said arm and lies between said flanks.

9. The door check of claim 8 wherein said head projects from both sides of said arm.

10. The door check of claim 7 including a stop plate adjacent to said arm and wherein said head is operable to engage said stop plate.

11. The door check of claim 10 wherein said stop plate has formations thereon to locate said head laterally on said stop plate.

12. The door check of claim 1 wherein said mounting bracket is co-moulded with fasteners adapted to structurally attach the unitary energy storage component to a vehicle door structure.

13. The door check of claim 12 wherein one end of said arm is provided with an enlarged head to limit relative movement of said arm and unitary energy storage component by engagement with a stop plate, said stop plate being attached to said energy storage component.

* * * * *

UNITED STATES PATENT AND TRADEMARK OFFICE

CERTIFICATE OF CORRECTION

PATENT NO. : 8,869,350 B2
APPLICATION NO. : 13/605582
DATED : October 28, 2014
INVENTOR(S) : Gruber It is certified that error appears in the above-identified patent and that said Letters Patent is hereby corrected as shown below:

Please delete Patent 8869350 in its entirety and insert Patent 8869350 in its entirety as shown on the attached pages Signed and Sealed this
First Day of September, 2015

Michelle K. Lee

Michelle K. Lee
*Director of the United States Patent and Trademark Office*

(12) United States Patent
Gruber

(10) Patent No.: US 8,869,350 B2
(45) Date of Patent: Oct. 28, 2014

(54) TORSION BAR DOOR CHECK

(75) Inventor: Rudolf Gruber, Uxbridge (CA)

(73) Assignee: Multimatic Inc., Markham (CA)

( * ) Notice: Subject to any disclaimer, the term of this patent is extended or adjusted under 35 U.S.C. 154(b) by 0 days.

(21) Appl. No.: 13/605,582

(22) Filed: Sep. 6, 2012

(65) Prior Publication Data

US 2013/0055530 A1 Mar. 7, 2013

Related U.S. Application Data

(63) Continuation-in-part of application No. 13/226,348, filed on Sep. 6, 2011, now abandoned.

(51) Int. Cl.
*E05C 17/20* (2006.01)
*E05B 15/16* (2006.01)

(52) U.S. Cl.
CPC ..... *E05B 15/1635* (2013.01); *E05C 17/203* (2013.01)
USPC ..... 16/85; 16/82

(58) Field of Classification Search
CPC ..... E05C 17/00; E05C 17/025; E05C 17/203; E05C 17/206; E05C 17/22; E05C 17/24; E05C 17/26; E05C 17/28; E05C 21/005; E05F 5/025; E05F 5/00; E05F 5/022; E05B 2015/0455
USPC ..... 16/85, 82, 86 R, 86 A, 86 B, 86 C, 334; 292/262, 265, 275, 277
See application file for complete search history.

(56) References Cited

U.S. PATENT DOCUMENTS

| | | | | |
|---|---|---|---|---|
| 2,125,010 | A * | 7/1938 | Wright | 16/86 C |
| 2,204,330 | A * | 6/1940 | Travis | 16/85 |
| 2,204,331 | A * | 6/1940 | Travis | 16/85 |
| 2,237,046 | A * | 4/1941 | Breitenwischer | 16/86 C |
| 2,291,412 | A * | 7/1942 | Schonitzer | 16/86 C |
| 5,026,103 | A | 6/1991 | Tolle et al. | |
| 5,112,091 | A | 5/1992 | Kluting | |
| 5,173,991 | A | 12/1992 | Carswell | |
| 6,370,733 | B2 | 4/2002 | Paton et al. | |
| 6,481,056 | B1 | 11/2002 | Jesse | |

(Continued)

FOREIGN PATENT DOCUMENTS

| | | |
|---|---|---|
| EP | 0111380 B1 | 6/1984 |
| GB | 795867 A | 6/1956 |

(Continued)

OTHER PUBLICATIONS

McTavis, Megan; International Search Report from corresponding PCT Application No. PCT/CA2012/050614; search completed Dec. 19, 2012.

*Primary Examiner* — Jeffrey O Brien
(74) *Attorney, Agent, or Firm* — John R. S. Orange; Blake, Cassels & Graydon LLP

(57) ABSTRACT

A door check for an automobile has an arm with a cam formed between oppositely directed flanks. A unitary energy storage component cooperates with the arm to provide progressive resistance to opening and closing and a plurality of stable positions. The unitary energy storage component includes a pair of springs, each connected to shoes that bear against the flanks and load the springs in torsion as the shoes moves along the cam. The unitary energy storage component is formed as an integral unit to facilitate handling and assembly.

13 Claims, 10 Drawing Sheets

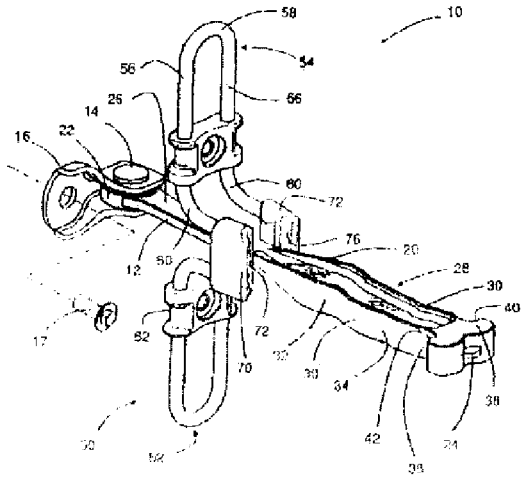

(56) References Cited

U.S. PATENT DOCUMENTS

| | | | | |
|---|---|---|---|---|
| 6,568,741 | B1 * | 5/2003 | Leung et al. | 16/334 |
| 6,687,953 | B1 | 2/2004 | Liang | |
| 6,842,943 | B2 | 1/2005 | Hoffmann et al. | |
| 6,880,204 | B2 * | 4/2005 | Ochiai | 16/82 |
| 6,901,630 | B2 * | 6/2005 | Liang et al. | 16/82 |
| 7,946,017 | B2 * | 5/2011 | Brown et al. | 29/426.6 |
| 2003/0101537 | A1 * | 6/2003 | Matsuki et al. | 16/85 |
| 2004/0049882 | A1 * | 3/2004 | Schmoll et al. | 16/82 |
| 2004/0060150 | A1 * | 4/2004 | Krozek | 16/86 C |
| 2004/0111832 | A1 * | 6/2004 | Murayama et al. | 16/82 |
| 2004/0148735 | A1 * | 8/2004 | Spalding et al. | 16/82 |
| 2006/0150367 | A1 * | 7/2006 | Matsuki | 16/86 C |
| 2006/0207058 | A1 * | 9/2006 | Heinrichs et al. | 16/86 B |
| 2006/0207059 | A1 * | 9/2006 | Van Den Heuvel | 16/86 B |
| 2007/0245519 | A1 * | 10/2007 | Woo | 16/86 C |
| 2008/0066260 | A1 | 3/2008 | Clark | |
| 2009/0070956 | A1 * | 3/2009 | Hoffmann et al. | 16/82 |
| 2011/0016665 | A1 | 1/2011 | Ng | |

FOREIGN PATENT DOCUMENTS

| | | | |
|---|---|---|---|
| WO | 03042477 | A1 | 5/2003 |
| WO | 2009124373 | A1 | 10/2009 |

* cited by examiner

TORSION BAR DOOR CHECK

CROSS-REFERENCE TO RELATED APPLICATIONS

This application is a continuation-in-part of U.S. patent application Ser. No. 13/226348 filed on Sep. 6, 2011, the contents of which are incorporated herein by reference.

FIELD OF THE INVENTION

This invention relates to automotive door checks, and in particular to a compact mechanical device capable of holding an automotive door in one or more predetermined open positions with a predetermined force.

DESCRIPTION OF THE PRIOR ART

It has been found useful to check the movement of an automotive door in a number of predetermined open positions to assure convenient and safe ingress/egress of the occupants. The door is normally checked against movement in at least one open position with an effort or resistive force adequate to resist wind gusts and the effect of parking on an incline or grade.

The most common form of automotive door check is a mechanical device that resists motion by releasably storing energy in response to forced motion of the system. These devices, located between the vehicle's body structure and door, can be configured to be integral with the door hinge or separate as autonomous mechanical assemblies. Energy storage is generally achieved by a form of spring with coil and torsion arrangements being the most popular configurations. As the door is opened or closed, the door check is configured to release energy entering the check positions and to store it when moving out of the check positions. The most common method of storing energy in the spring system is by means of a cam arrangement that moves in conjunction with the door. This cam can work within the hinge to ultimately produce a torque around the pivot axis of the hinge, or can work linearly in a separate checking apparatus which produces a force vector to resist door movement at selected opening positions.

U.S. Pat. No. 5,173,991 to Carswell describes a common type of separate door checking apparatus that utilizes a molded link member to provide a cam arrangement and a pair of coil springs to releasably store energy. The coil springs are contained in a check housing and are acted upon by the molded link member via ball bearings and ball bearing retainers. The check housing is rigidly attached to the vehicle door and the molded link member is pivotally connected to the vehicle body structure. The device of Carswell provides a robust, reliable and relatively compact solution for checking the movement of an automotive door. There are numerous similar solutions that utilize rollers or sliders in place of the ball bearings of Carswell. U.S. Pat. No. 6,370,733 to Paton et. al. describes a separate checking apparatus that utilizes a molded link member or check arm and rollers. U.S. Pat. No. 6,842,943 to Hoffmann et. al. describes a separate checking apparatus that utilizes a molded check arm and sliders.

Because the automotive door check must be located between the vehicle's body structure and door, it is forced to occupy a severely restricted package space as there is limited clearance between the vehicle body structure and the door and very little volume available within the door. Additionally, the weight of the automotive door check apparatus must not be too great as a significant proportion of the door check apparatus mass resides within the door profile, which swings on a pivot and is highly sensitive to weight. In general, the manufacturing costs of automotive components are among the lowest of any comparable industry and so simple solutions with low part counts are highly desirable. The main focus of an automotive door check development is to attain the required check efforts in the smallest possible package at the lowest achievable weight and cost. Using as few components as possible is highly desirable as is the ease of assembly in to the body structure and the ability of the apparatus to withstand manufacturing processes to which the body structure is subjected. The type of spring and its related strain energy storage capability combined with the package efficiency of the actuation mechanism ultimately dictate the overall effectiveness of the automotive door check apparatus.

U.S. Patent Application 2011/0016665 to Ng shows an elegant solution of door check in which the number of components is reduced to an arm and a unitary body. The unitary body is formed with a pair of leaf springs that cooperate with the arm to store and release energy as the arm moves relative to the housing. This arrangement minimizes the number of components and thereby offers significant advantages. The use of leaf springs reduces the number of components required, but at the same time requires close control of the manufacturing process to attain the required consistency of operation. Relatively small variations in the material and dimensions can introduce variability in the characteristics of the leaf springs, that may not be acceptable to the ultimate end user of the door check.

The manufacturing tolerances affecting the characteristics of a torsion spring are easier to control. U.S. Pat. No. 6,687,953 to Leang discloses a door check device in which a torsion spring is utilized to bias rollers against the flanks of the door check arm. Whilst the torsion spring provides uniform physical characteristics, the arrangement shown in Leang, utilizes a significant number of components including rollers and a housing in which the torsion spring is supported. This introduces mechanical complexity and weight to the assembly, as well as requiring assembly to the door after body has been painted as the components cannot withstand the painting process.

EP 1759080 to Friedr. Fingscheidt GmbH shows a door check in which a spring steel wire is bent in to a complex shape to provide an energy storage device. The forming of the wire is complex and work intensive. In the majority of embodiments, the storage element acts on only one side of the check strap and additional components are required to provide support for the resilient energy storage device. The configuration of the latching elements in embodiments that act on both sides of the check straps introduces complex loading and limits the free length of the energy storage devices.

It is therefore an object of the present invention to provide a door check in which the above disadvantages are obviated or mitigated.

SUMMARY OF THE INVENTION

In general terms, the present invention provides a door check which has a check arm and a unitary energy storage component that cooperates with the arm as a door moves between open and closed positions. The unitary energy storage component is integrally formed as a single component that functions to store energy and facilitate assembly and handling. The unitary energy storage component utilizes a pair of torsion springs that are each connected to shoes that slide on the arm as the door opens and closes. Mounting brackets are provided on the torsion springs which allow rotary motion between the brackets and springs as they are loaded in torsion. The springs, mounting brackets and shoes are co-moulded as an integral unit, preferably in a single molding operation, to facilitate handling and assembly.

In accordance with one aspect of the present invention there is provided a door check for an automobile comprising:

a) a check arm having cam surfaces formed on oppositely directed flanks;

b) a unitary energy storage component containing a pair of torsion springs;

c) the torsion springs integrally co-moulded with a pair of mounting brackets and a pair of shoes to create a single unitary component;

d) the torsion springs extending in opposite directions from the shoes.

e) the mounting brackets configured to allow rotary motion of the torsion springs and co-moulded with fasteners adapted to structurally attach the unitary energy storage component to a vehicle door structure;

such that the shoes of the unitary energy storage component are operably engaged with the flanks of the check arm to accommodate relative sliding movement between the check arm and the unitary energy storage component, whereby, movement of the shoes along said flanks varies the spacing between said shoes and thereby the energy stored in the torsion springs.

Preferably, each of the torsion springs has a pair of legs and the legs are loaded in torsion by variation of the spacing of the shoes.

Preferably, also feet extend from the legs and the shoes are connected to the feet.

Preferably, the brackets and shoes are molded on the springs after placement of the springs in a common mold to provide a unitary structure.

BRIEF DESCRIPTION OF THE DRAWINGS

Embodiments of the present invention will now be described by way of example only with reference to the accompanying drawings in which:

FIG. 1 is a representation of a door assembly with a door check showing the disposition of the components as a door moves from a closed to an open position.

FIG. 2 is a perspective view of a door check;

FIG. 3 is a plan view of the door check shown in FIG. 2;

FIG. 4 is an enlarged view of a portion of the door check at the position C shown in FIG. 1;

FIG. 5 is a side elevation of the door check shown in FIG. 2;

FIG. 6 is an end view of the door check shown in FIG. 2;

FIG. 7 is a schematic representation of the formation of a component of the door check of FIG. 2.

Figure 9:
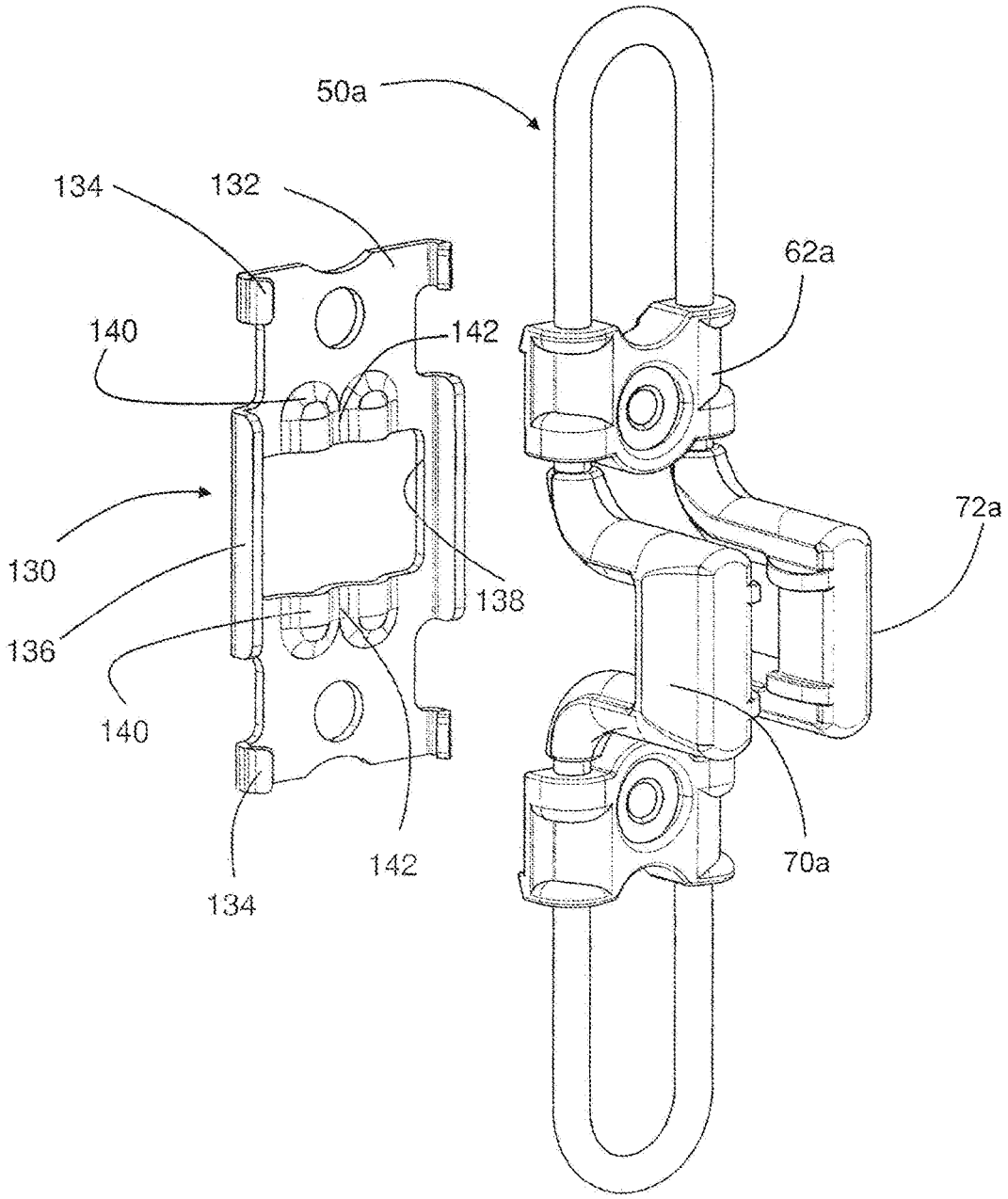
FIG. 9 is an exploded view of components mounted on one part of the door assembly.
Figure 11:
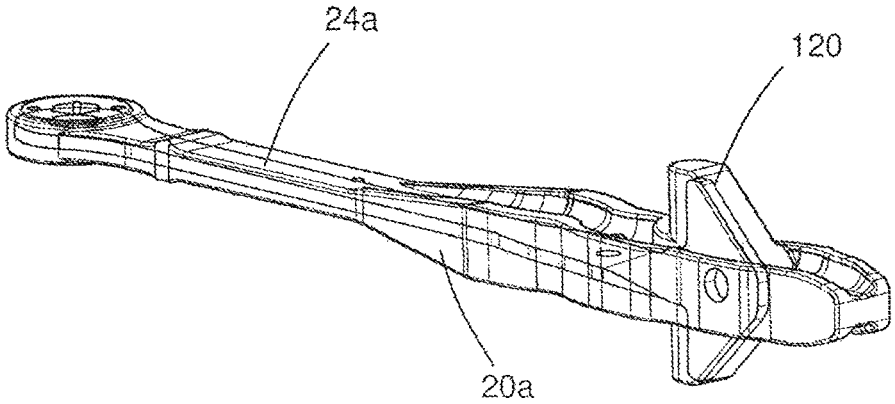
FIG. 11 is a schematic representation showing the formation of a check arm used in the embodiment of FIG. 8.
Figure 1:
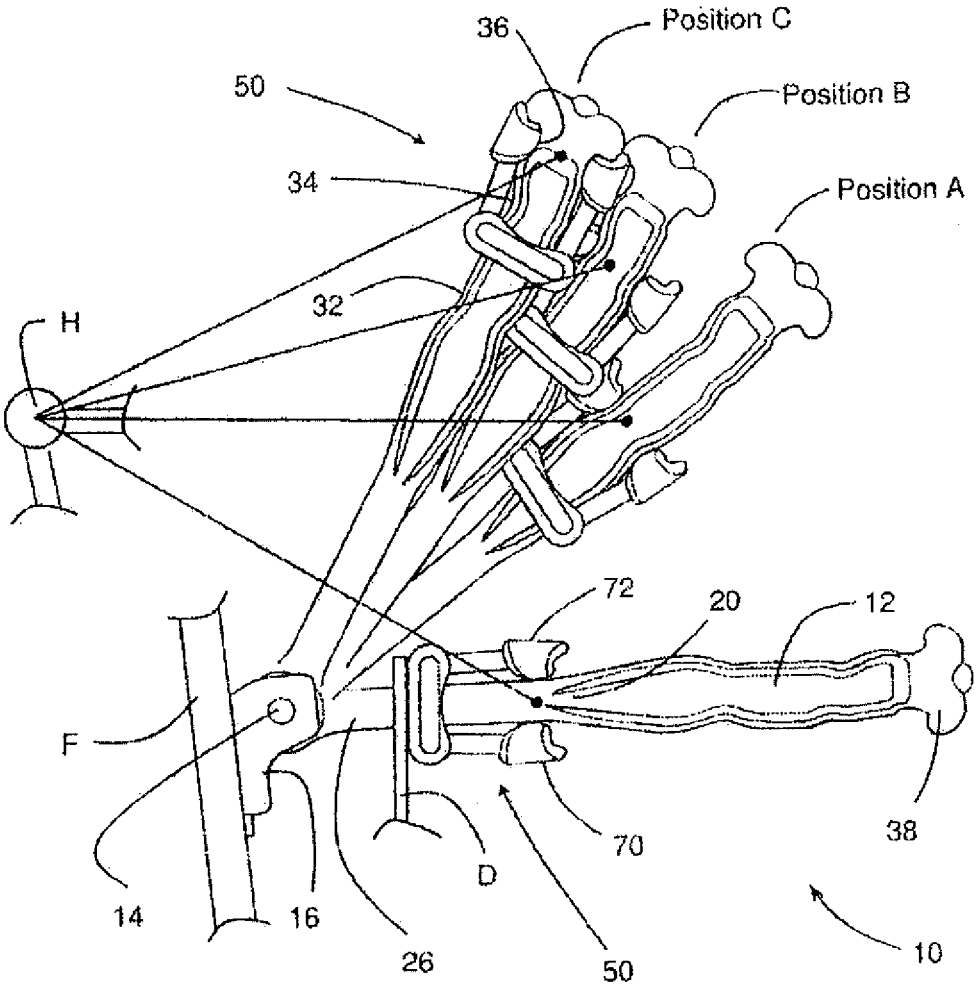
Figure 2:
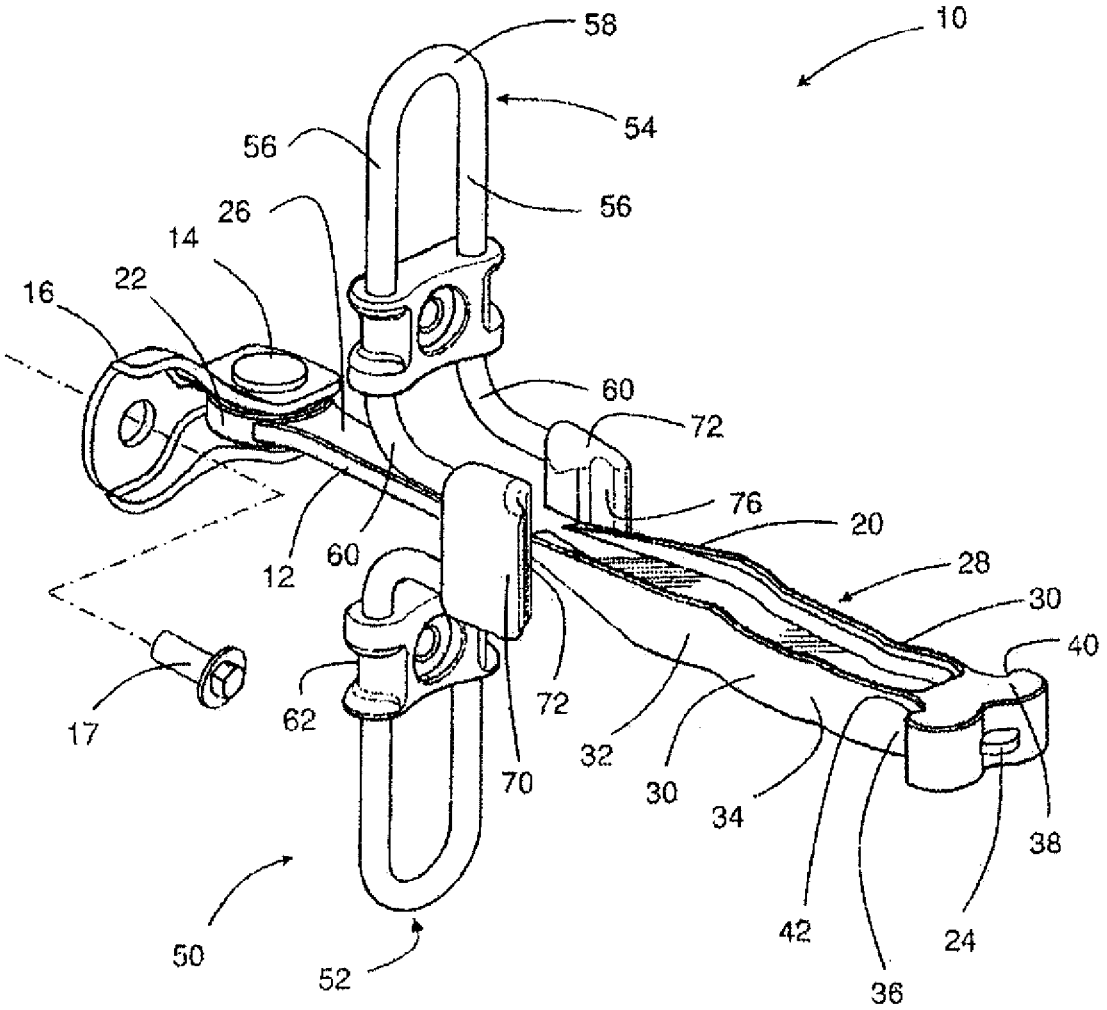
Figure 3:
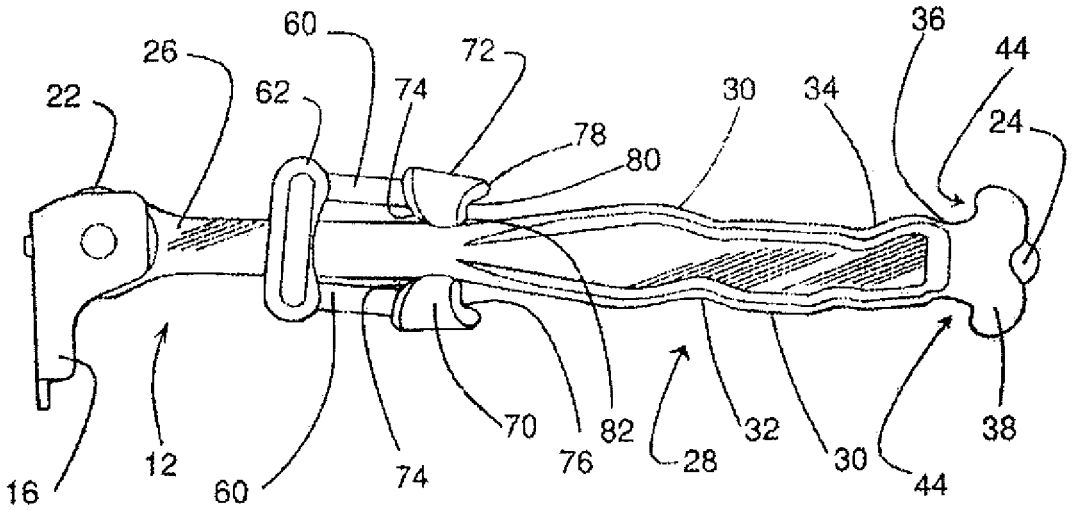
Figure 4:
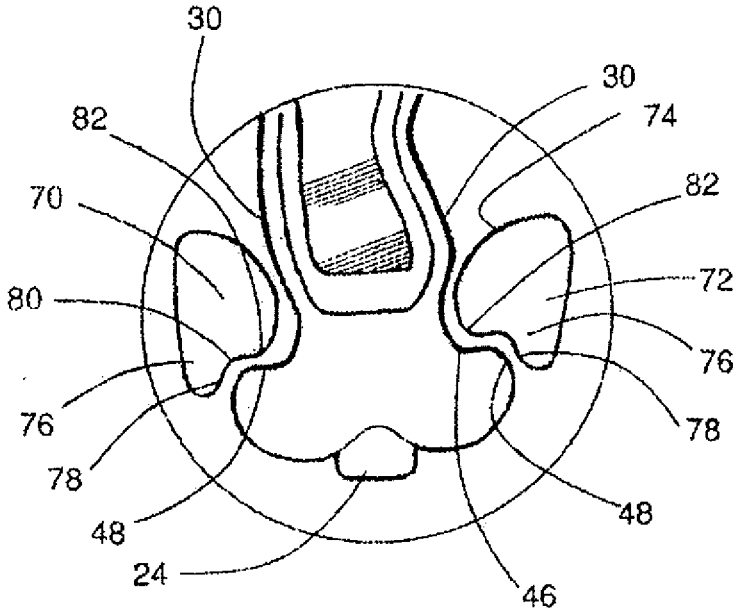
Figure 5:
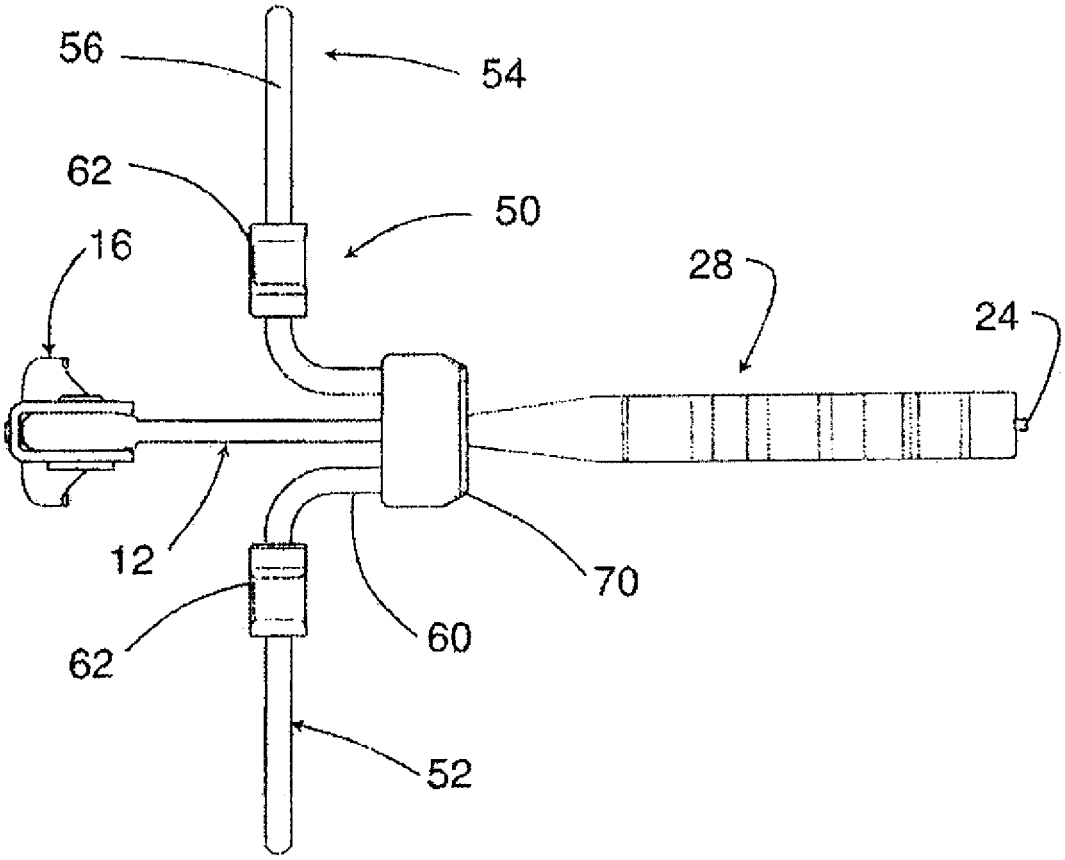
Figure 6:
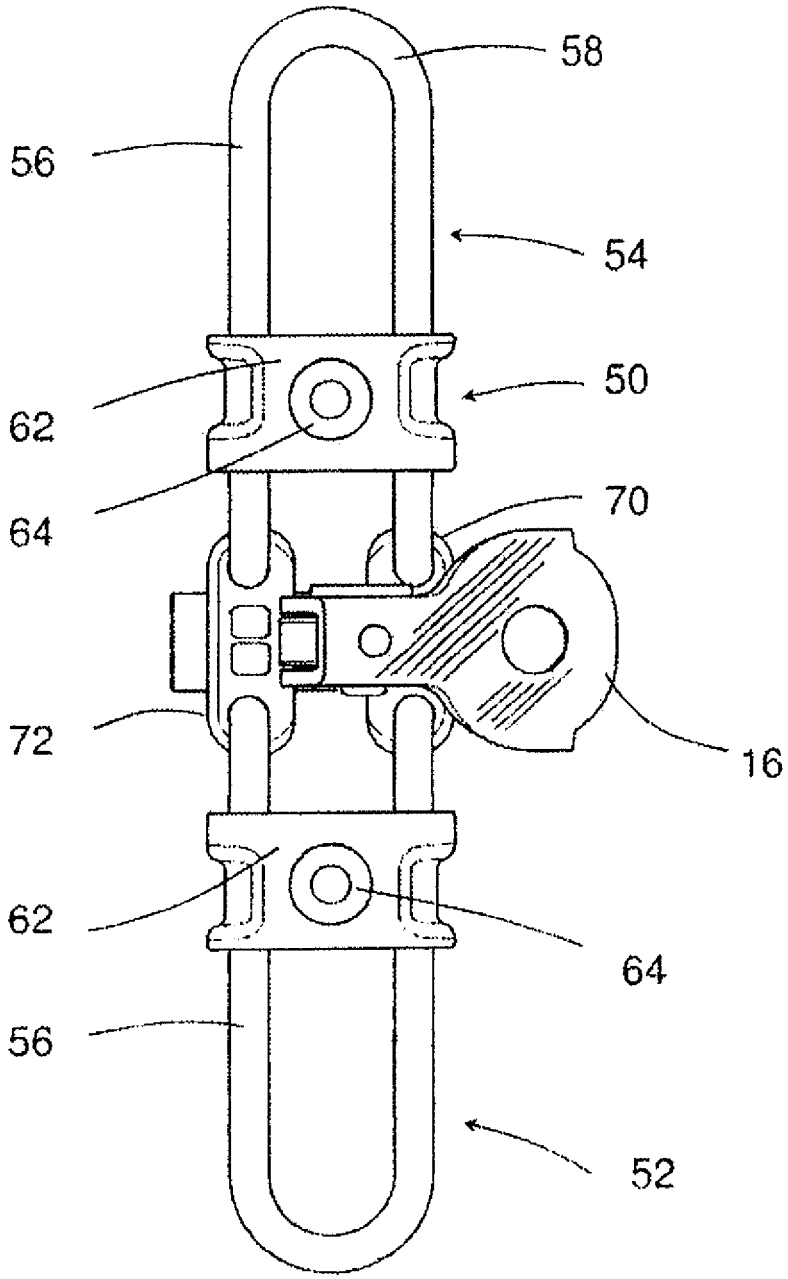
Figure 7:
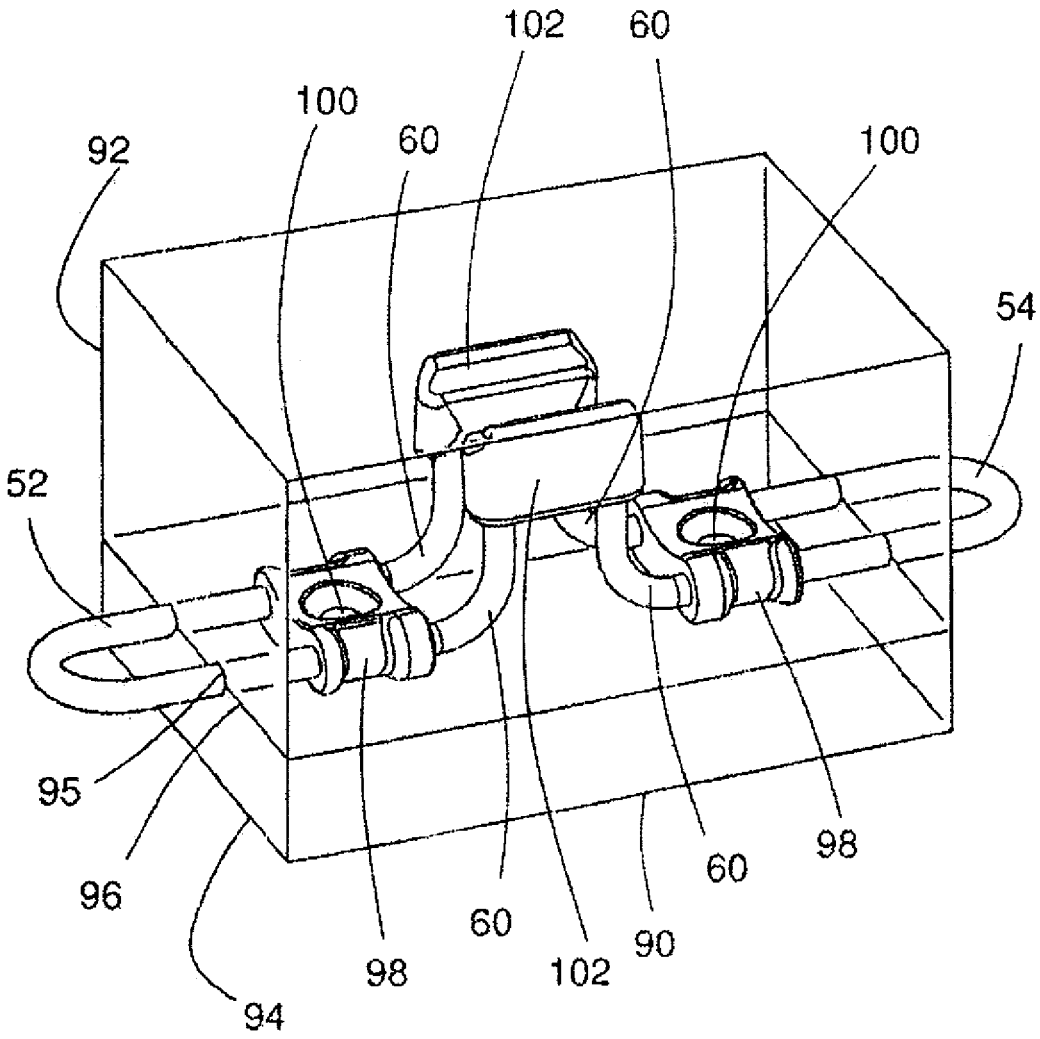
Figure 8:
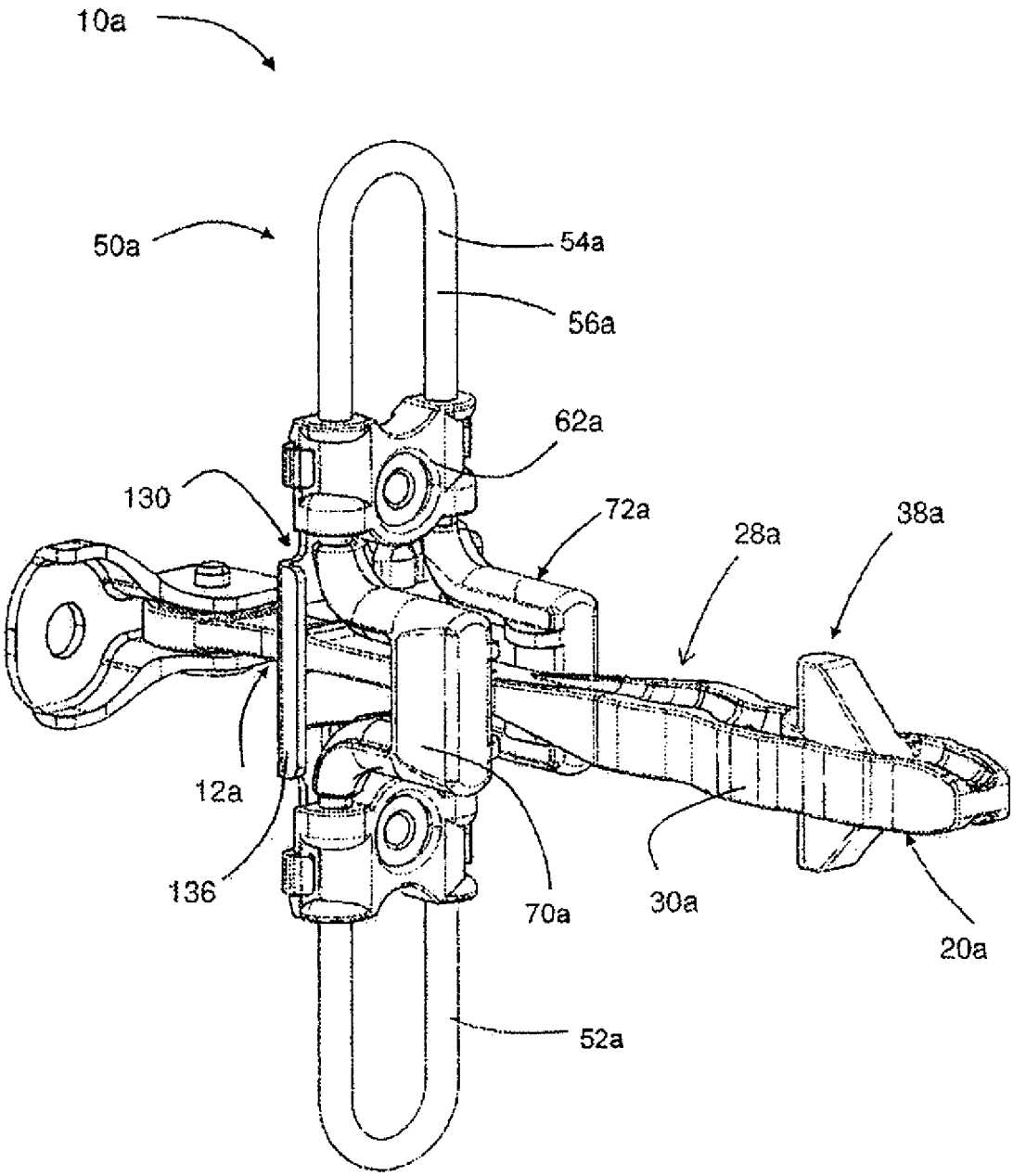
Figure 9:
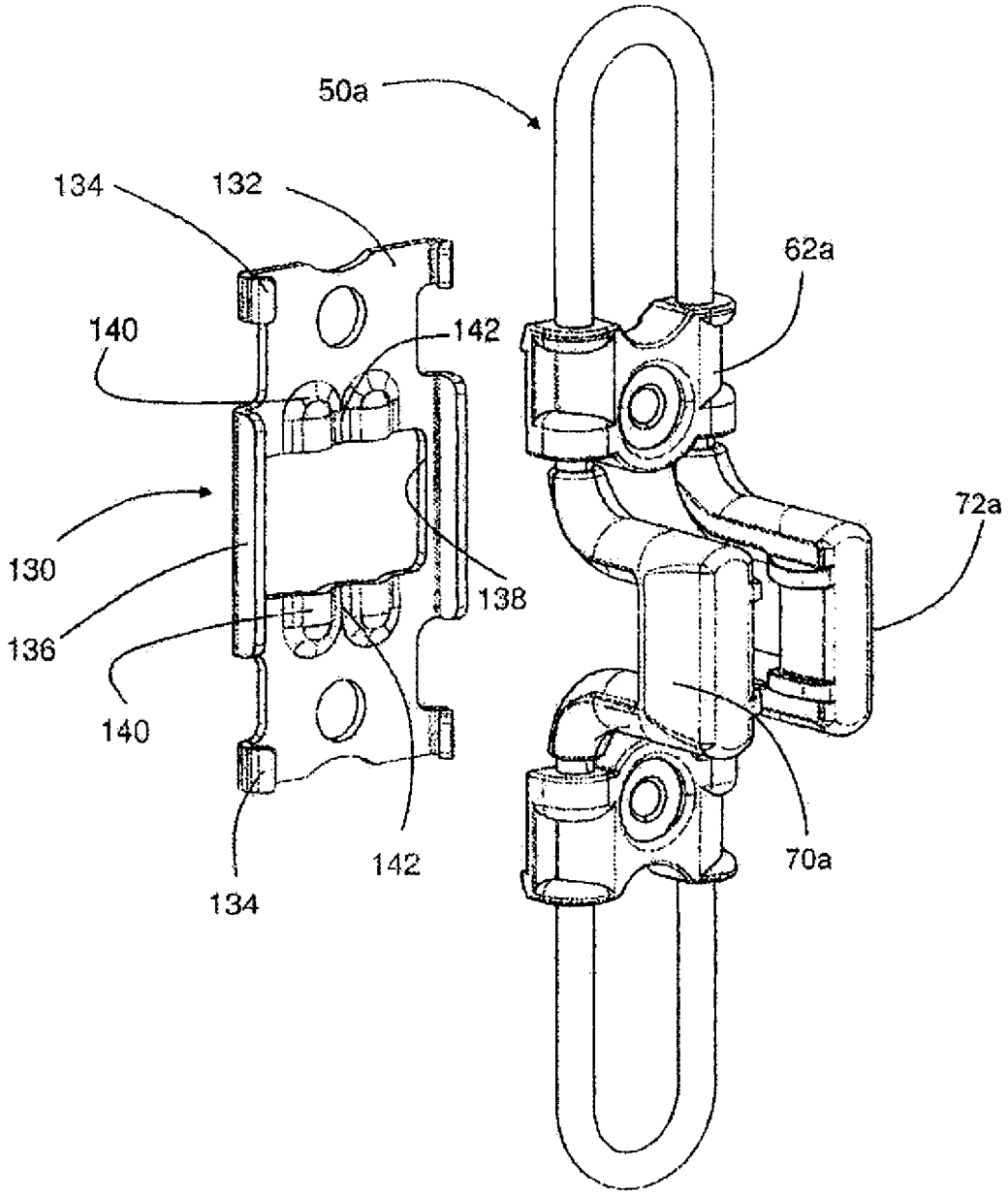
Figure 10:
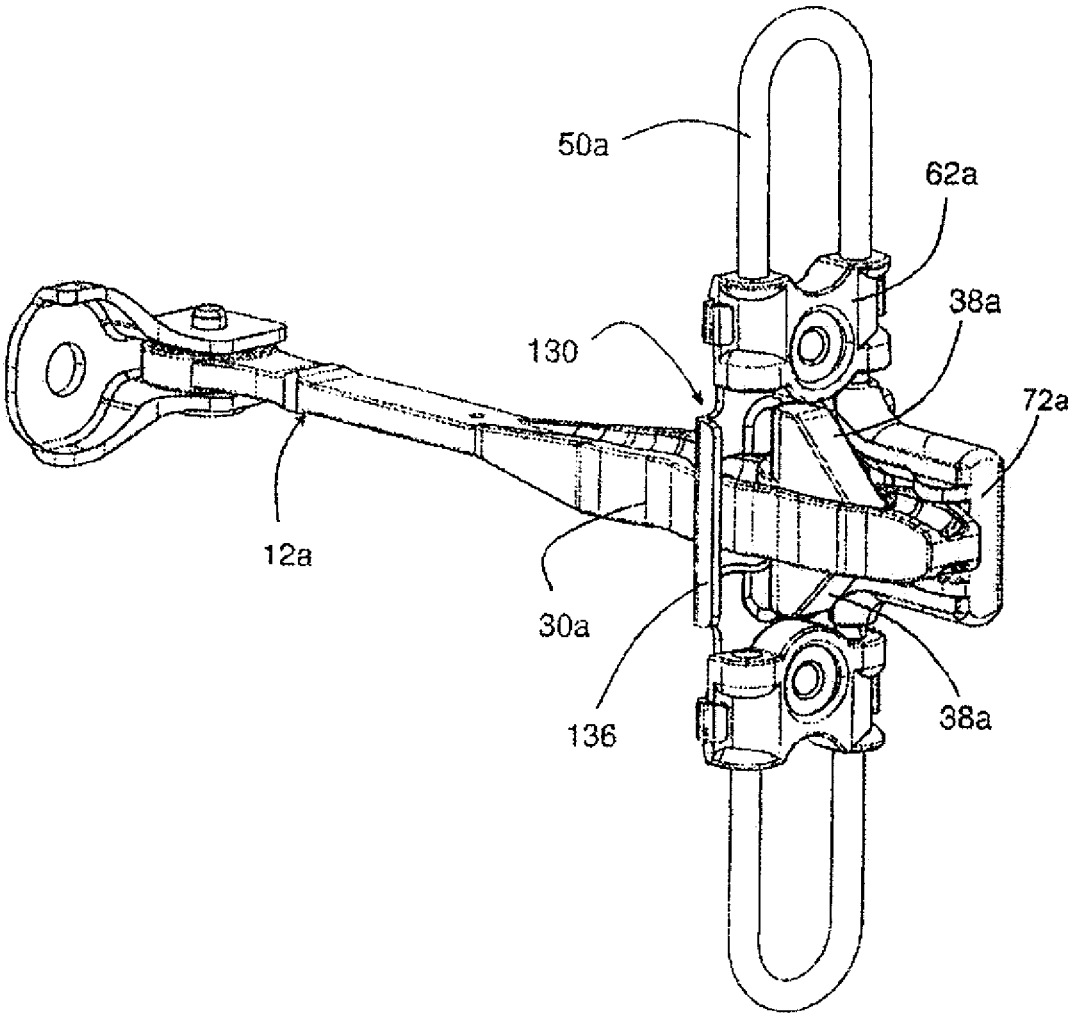
Figure 11:
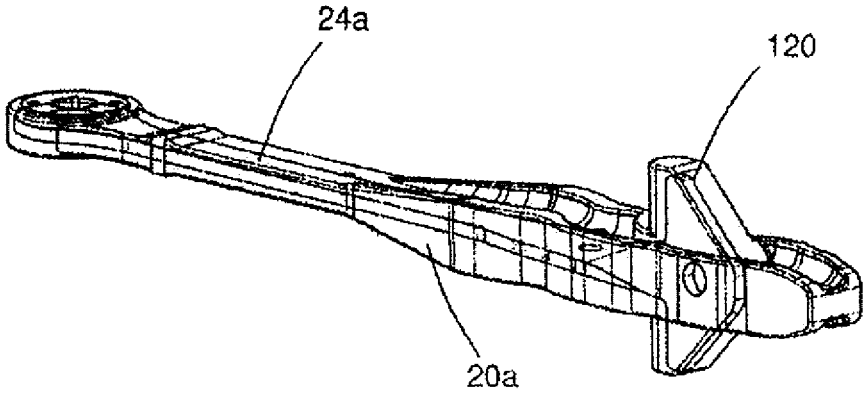

FIG. 8 is a perspective view similar to FIG. 2 of an alternative embodiment of door check;

FIG. 9 is an exploded view of components mounted on one part of the door assembly;

FIG. 10 is a view similar to FIG. 8 of the door check in a fully open position with a portion of the door check removed for clarity; and FIG. 11 is a schematic representation showing the formation of a check arm used in the embodiment of FIG. 8.

DETAILED DESCRIPTION OF EMBODIMENT

Referring therefore to FIG. 1, a door check 10 is located between a door frame F and a door D of a vehicle. The door D is pivotally connected to the frame F by means of a hinge H, that defines an axis of rotation of the door D relative to the frame F.

As best seen in FIGS. 2 and 3, the door check 10 includes a check arm 12 that is pivotally connected by a pin 14 to a clevis plate 16. The clevis plate 16 is secured to the frame F through a bolt, 17, or similar fastener to locate the arm 12 relative to the frame.

The arm 12 has an elongate body 20 that extends from a knuckle 22, through which the pin 14 passes. The body 20 is molded from a plastics material about a central metallic core 24. The body 20 includes a shank 26 extending from the knuckle 22 that in turn merges with a cam 28. The cam 28 is moulded to provide a generally I-shaped cross section with oppositely directed flanks 30.

The width of the cam 28, that is the lateral spacing between the flanks 30, varies along the length of the arm 12 with localized reductions in the width to provide waisted portions 32, 34, 36 at spaced locations.

Referring to FIGS. 3 and 4, the distal end of the arm 12 is formed with an enlarged head 38, which has a pair of undercut lobes 40, 42 projecting laterally to either side of the arm 12. The lobes 40, 42 each have an abutment face 44 formed by a curved recess 46 adjacent the flank 30 and a protuberance 48 outboard of the recess 46.

Referring again to FIG. 2 and to FIG. 6, the door check 10 further includes a unitary energy storage component 50 secured to the door D and cooperating with the arm 12 to control pivotal movement between the door and the frame F. The unitary energy storage component 50 includes a pair a torsion springs 52, 54 that extend to opposite sides of the arm 12. Each of the springs 52, 54 has a pair of parallel legs 56 interconnected by a curved bight 58. The end of the legs 56 turn through 90° to provide a pair of parallel projecting feet 60.

The legs 56 are maintained in spaced parallel relationship by means of a bracket 62. The bracket 62 is made from a plastics material, such as a glass filled nylon 66 known by the trade name Zytel, that, as described in greater detail below, is moulded about the legs 56. A fastener 64, either a nut, bolt or similar fastener, is embedded in the bracket 62 to facilitate connection of the bracket 62 to the door D. As seen in FIGS. 2,5 and 6, the bracket 62 encompasses the legs 56 so as to be retained in situ on the legs 56 but permits rotation of the leg within the bracket 62 about the longitudinal axis of the legs 56. The appropriate selection of the materials, or localised surface treatment, ensures that the bracket 62 does not adhere to the legs 56 and so permits the limited rotational movement of the legs 56 relative to the bracket 62.

The torsions springs 52, 54 are disposed on opposite sides of the arm 12 and are interconnected by a pair of shoes 70, 72. The shoes 70, 72 are secured to respective ones of the feet 60 so the springs 52, 54 and shoes 70, 72 provide a unitary structure. The shoes 70, 72 are moulded from a high density low friction plastic, such as an acetal known by the trade name Delrin, that are integrally moulded to the feet 60 to provide a unitary construction.

As seen most clearly in FIGS. 3 and 4, the inwardly directed face 74 of the shoes 70, 72 is contoured to provide a generally convex surface that is complementary to the waisted portions 32, 34, 36 of cam 28. The leading edge 76 of each of the shoes 70, 72 is undercut to be complementary to the contours of abutment face 44 of lobes 40, 42. Each of the leading edges 76 has an outer lip 78 that merges smoothly with a recess 80 of complimentary profile to the protuberance 48. A nose 82 projects from the recess 80 and is complimentary to the recess 46 on the head 38.

The lateral spacing of the legs 56 is such that, when the shoes 70, 72 are positioned on the shank 26, there is a small preload in the torsion springs 52, 54, to bias the convex surfaces 74 of the shoes 70, 72 against the shank 26 while offering nominal resistance to movement. The springs 52, 54 are made from a suitable spring material, such as a standard music wire.

In use, with the door closed, the shoes 70, 72 are in sliding engagement with the flanks 30 adjacent to the transition between the shank 26 and cam 28 of the arm 12. In this position, the legs 56 are in their free body condition with the shoes 70, 72 in sliding engagement with the flanks 30.

As the door opens, relative movement between the arm 12 and the unitary energy storage component 50 causes the shoes 70, 72, slide along the flanks 30. The arm 12 progressively widens and the increased spacing of the flanks 30 forces the shoes 70, 72 apart. The increased spacing of the shoes 70, 72 rotates the legs 56 in opposite directions and stores energy within the torsion springs 50, 52 by torsionally loading the legs 56. Each of the springs 52, 54 is similarly loaded and the forces acting on opposite side of the arm in 12 are balanced.

Continued movement of the door, as indicated in FIG. 1, moves the shoes 70, 72 in to the first waisted portion 32 indicated at position A. As the shoes 70, 72 enter the first waisted portion 32, energy is released from the legs 56 and the convex face 74 of the shoes 70, 72 is received within the waisted portion 32. Movement of the shoes 70, 72 from the waisted portion 32 requires the legs 56 to be rotated causing energy to be re-stored in the legs 56. Accordingly, extraneous forces resulting from the mass of the door or the forces imposed by gusts of wind may be resisted.

Continued movement of the door again forces the shoes 70, 72 apart and stores energy in the torsion springs 52, 54. A further stable position for the door is provided when the shoes 70, 72 engage the waisted portion 34 indicated at position B. Continued movement beyond the waisted portion 34 moves the shoes 70, 72 in to the waisted portion 36 and into engagement with the head 38 as shown in position C. The head 38 thus provides a stop to define the maximum opening of the door.

In that position, as can best be seen in FIG. 4, the nose 82 enters the recess 46. The interaction of the nose 82 with the protuberance 48 inhibits relative lateral displacement of the shoes 70, 72 upon continued application of a force to the door.

Return of the door to the closed position causes the shoes 70, 72 to move along the flanks 30 and through the waisted portions 32, 34 until once again on the shank 26. The profile of the cam 28 is selected to provide the required resistance to sliding motion during travel between the waisted portions, and the required retention in each of the waisted portions.

As shown schematically in FIG. 7, the unitary energy storage component 50 is formed by moulding the bracket and shoes 70, 72 to the torsion springs 52, 54 in a single molding operation to provide a unitary construction. A mold 90 is formed with upper and lower halves, 92, 94 that abut on a parting plane 96. A semi cylindrical track 95 is formed in each of the halves to receive and to locate the legs 56 of the springs 52, 54. The legs 56 pass through a lateral cavity 98 that is shaped to provide the brackets 62. A central boss 100 locates the fastener in the cavity 98. The feet 60 are received in shoe cavities 102 that are shaped to provide the profile of the shoes 70, 72.

With the mold 90 open, the springs 52, 54 are placed on the track 95 and fasteners 64 placed on the boss 100. The mold 90 is closed and plastics material injected in to the cavities 98, 102. Upon solidification, the mold 90 is opened and the unitary energy storage component 50 may be removed as a single component.

The unitary energy storage component 50 is therefore is provided as a single component with the shoes 70, 72 providing sufficient structural rigidity to maintain the unit 50 as one piece. After the unitary energy storage component 50 is mounted to the door, the brackets 62 maintain the relationship between the torsion springs and thereby permit the shoes to simply function as the slides rather than being required to maintain the structural integrity of the unitary energy storage component. The integral nature of the unitary energy storage component 50 and the absence of rollers and the like also enables the door check to be assembled with the body prior to painting, thereby simplifying subsequent assembly.

An alternative embodiment of door check assembly is shown in FIGS. 8 to 11 in which like reference numerals will be used to denote like components with a suffix "a" added for clarity.

Referring therefore to FIG. 8, a door check **10*a* has a check arm 12*a* with an elongate body 20*a*. The body 28*a* includes a cam 28*a* defined by flanks 30*a*. As can be seen in FIG. 12, the body 20*a* is moulded from a plastics material about a central metallic core 24*a*. The distal end of the shank 24*a* is formed with a triangular head 120 that is disposed orthogonal to the plane of the shank 24*a*. The head 120 provides an enlarged head 38*a* projecting to opposite sides of the cam 28*a* and lying between the flanks 30*a*. The head 38*a* is thus able to pass between the shoes 70*a* upon relative movement between the arm 12*a* and the energy storage component 50*a***.

The energy storage component **50*a* includes a pair of torsion springs 52*a*, 54*a* and are interconnected by shoes 70*a*, 72*a* to provide a unitary structure as described above. Brackets 62*a* maintain the legs 56 in space parallel relationship and provide mounting points for the energy storage component 50*a*** to the door D.

A stop plate 130 is interposed between the energy storage component **50*a* and the door D. The stop plate 130 is formed as a separate component and may be secured to the energy storage component 50*a*. by for example tags or clips, to facilitate transportation and assembly, or may be permanently secured by integrating it in the molding process if appropriate. The stop plate has a planar body 132 and upturned edges 134, 136. The edges 134 engage with the bracket 62*a* to locate the plate 130 relative to the energy storage component 50*a*. The planar body 132 has a central aperture 138 through which the arm 12*a* may pass. A pair of ridges 140 are formed in the planar body 132 on oppositely facing edges of the periphery 138. The ridges 140 define a valley 142 centrally located on the plate 132**.

The ridges 140 and valley 142 are configured so that the enlarged head **38*a* engages in the valley 140 to locate the head laterally relative to the plate. As can be seen in FIG. 10, the head 38*a* engages the plate 130 to limit relative movement between the door and the car body thus providing a stop to define the maximum opening of the door. The forces imposed on the arm 12*a* are reacted by the plate 130, rather than by the shoes 70*a*** as in the previous embodiment.

It will also be noted that the configuration of the enlarged head **38*a* between the flanks 30*a* enables the head 30*a* to be moved within the longitudinal extent of the cam 28*a*** and therefore reduce the overall length of the door check, which reduces the volume required to mount the component in an automotive door that typically also needs to accommodate many other mechanisms such as window regulators, drop glass and audio speakers in the same general area.

What is claimed is:

1. A door check for an automobile comprising:

a) a check arm having cam surfaces formed on oppositely directed flanks;

b) a pair of shoes engaged with said cam surfaces;

c) a unitary energy storage component containing a pair of torsion springs, each of said torsion springs having a pair of legs;

d) each of the torsion springs supported by a respective one of a pair of mounting brackets;

e) each leg of one of the torsion springs being connected to the leg of another of the torsion springs by a respective one of said pair of shoes, said torsion springs extending in opposite directions from the shoes, said springs, mounting brackets and said pair of shoes creating a single unitary component;

f) the mounting brackets configured to allow rotary motion of the torsion springs relative to said mounting brackets;

such that the shoes of the unitary energy storage component are operably engaged with the flanks of the check arm to accommodate relative sliding movement between the check arm and the unitary energy storage component, whereby, movement of the shoes along said flanks varies the spacing between said shoes and thereby the energy stored in the torsion springs.

2. The door check according to claim 1 wherein feet extend from said legs and said shoes are connected to said feet.

3. The door check according to claim 1 wherein said cam is formed with at least one waisted portion in which the spacing between said flanks is locally minimized to provide a check position of said shoes along said arm.

4. The door check according to claim 1 wherein one end of said arm is provided with an enlarged head to limit relative movement of said arm and unitary energy storage component.

5. The door check according to claim 4 wherein said head has an abutment face engageable with said shoes and said abutment face is profiled to inhibit lateral movement of said shoes.

6. The door check according to claim 5 wherein each of said shoes has a nose received in a respective recess of said abutment surface.

7. The door check of claim 4 wherein said head is oriented to pass between said shoes.

8. The door check of claim 7 wherein said head projects from said arm and lies between said flanks.

9. The door check of claim 8 wherein said head projects from both sides of said arm.

10. The door check of claim 7 including a stop plate adjacent to said arm and wherein said head is operable to engage said stop plate.

11. The door check of claim 10 wherein said stop plate has formations thereon to locate said head laterally on said stop plate.

12. The door check of claim 1 wherein said mounting bracket is co-moulded with fasteners adapted to structurally attach the unitary energy storage component to a vehicle door structure.

13. The door check of claim 12 wherein one end of said arm is provided with an enlarged head to limit relative movement of said arm and unitary energy storage component by engagement with a stop plate, said stop plate being attached to said energy storage component.

* * * * *